US005573903A

United States Patent [19]

Yamashita et al.

[11] Patent Number: 5,573,903

[45] Date of Patent: Nov. 12, 1996

[54] SILVER HALIDE PHOTOGRAPHIC MATERIAL AND SILVER HALIDE PHOTOGRAPHIC EMULSION USED THEREFOR

[75] Inventors: Seiji Yamashita; Tetsuro Kojima; Hiroyuki Mifune; Mikio Ihama; Hirotomo Sasaki, all of Kanagawa, Japan

[73] Assignee: Fuji Photo Film Co., Ltd., Kanagawa, Japan

[21] Appl. No.: 402,557

[22] Filed: Mar. 13, 1995

Related U.S. Application Data

[63] Continuation of Ser. No. 197,570, Feb. 17, 1994, abandoned, which is a continuation of Ser. No. 866,515, Apr. 10, 1992, abandoned.

[30] Foreign Application Priority Data

Apr. 11, 1991 [JP] Japan ..... 3-105035
Jun. 28, 1991 [JP] Japan ..... 3-183863

[51] Int. Cl.[6] ..... G03C 1/09; G03C 1/34

[52] U.S. Cl. ..... 430/600; 430/550; 430/551; 430/601; 430/603; 430/605; 430/607; 430/614; 430/567

[58] Field of Search ..... 430/551, 556, 430/567, 601, 603, 605, 607, 614, 600, 550

[56] References Cited

U.S. PATENT DOCUMENTS

| | | | |
|---|---|---|---|
| 4,401,754 | 8/1983 | Suzuki et al. | 430/603 |
| 4,443,537 | 4/1984 | Postle et al. | 430/566 |
| 5,112,733 | 5/1992 | Ihama | 430/605 |
| 5,238,807 | 8/1993 | Sasaki et al. | 430/603 |

FOREIGN PATENT DOCUMENTS

| | | | |
|---|---|---|---|
| 428041 | 5/1991 | European Pat. Off. | 430/603 |
| 476521 | 3/1992 | European Pat. Off. . | |
| 59-97134 | 6/1984 | Japan . | |

OTHER PUBLICATIONS

Defensive Publication 808669, Herz, Jul. 15, 1969.

*Primary Examiner*—Richard L. Schilling
*Attorney, Agent, or Firm*—Sughrue, Mion, Zinn, Macpeak & Seas

[57] ABSTRACT

A silver halide photographic material having the improved storability and anti-stress property is disclosed, which comprises a support having provided thereon at least one light-sensitive silver halide emulsion layer containing a silver halide emulsion, wherein the silver halide emulsion is subjected to a chemical sensitization with a selenium compound, and the emulsion layer or another layer provided on the support contains at least one of the compounds represented by formulas (I), (II) and (III):

wherein $R_{11}$ to $R_{16}$, $R_{21}$ to $R_{26}$, $R_1$ and $R_2$ are defined in the specification.

9 Claims, No Drawings

SILVER HALIDE PHOTOGRAPHIC MATERIAL AND SILVER HALIDE PHOTOGRAPHIC EMULSION USED THEREFOR

This is a continuation of application Ser. No. 08/197,570 filed Feb. 17, 1994, now abandoned, which is a continuation of application Ser. No. 07/866,515 filed Apr. 10, 1992, now abandoned.

FIELD OF THE INVENTION

The present invention relates to a silver halide photographic material and a silver halide emulsion suitably used therefor.

BACKGROUND OF THE INVENTION

In recent years, rapid processing at high temperature has rapidly been popularized in a developing step of a photographic material (hereinafter referred to as a light-sensitive material). Also in a processing of various light-sensitive materials with an automatic developing machine, a processing time thereof has been shortened to a large extent. In order to achieve the rapid processing, there are needed a developing solution capable of providing sufficient sensitivity in a short time and a light-sensitive material having an excellent development accelerating property and capable of providing a sufficient photographic density in a short time. Efficient as a method for increasing an activity of a developing solution are a method in which the amounts of a developing agent and an auxiliary developing agent each contained in a developing solution are increased, a method in which pH of a developing solution is raised, and a method in which a processing temperature is raised. However, either of these methods has the problems that stability of a processing solution in storage is deteriorated and that a gradation decreases and a fog increases.

The techniques for utilizing tabular grains for the purpose of improving the above matters are described in U.S. Pat. Nos. 4,439,520 and 4,425,425. Further, there are described in JP-A-63-305343 (the term "JP-A" as used herein means an unexamined published Japanese patent application) and 1-77047, the techniques for improving a development accelerating property and a sensitivity/fog ratio by making development initiation points of a silver halide grain be only at its peak and/or ridgeline, or vicinity thereof. However, these techniques are still insufficient, and it has been desired to attain an excellent development accelerating property and a low fog while maintaining a high sensitivity.

A silver halide emulsion is usually subjected to a chemical sensitization with various chemical substances in order to obtain desired sensitivity and gradation. There are known as a representative method therefor, a sulfur sensitization, a selenium sensitization, a noble metal (for example, gold) sensitization, a reduction sensitization, and various sensitization methods in which the above sensitizations are combined.

In recent years, there are strong demands for high sensitivity, excellent graininess and high sharpness in a silver halide photographic material as well as rapid processing in which a development processing is expedited, and various improvements in the above sensitizing methods have been made.

Of the above sensitizing methods, the selenium sensitization is disclosed in U.S. Pat. Nos. 1,574,944, 1,602,592, 1,623,499, 3,297,446, 3,297,447, 3,320,069, 3,408,196, 3,408,197, 3,442,653, 3,420,670, and 3,591,385, French Patents 2,693,038 and 2,093,209, JP-B-52-34491 (the term "JP-B" as used herein means an examined Japanese patent publication), 52-34492, 53-295, and 57-22090, JP-A-59-180536, 59-185330, 59-181337, 59-187338, 59-192241, 60-150046, 60-151637, and 61-246738, JP-A-3-4221, 1-287380, 1-250950, 1-254441, 2-34090, 2-110558, 2-13097, 2-139183, and 2-229300, British Patents 255,846 and 861,984, and *Journal Photographic Science,* Vol. 31, pp. 158 to 169 (1983), written by H. E. Spencer et al.

While a selenium sensitization generally has a larger sensitizing effect than a sulfur sensitization usually applied in the art, it has a marked tendency of liability to cause much fog and soften a gradation. A large part of the above published patents improves the above defects but the results obtained are still insufficient. In particular, the basic improvement for controlling generation of fog has been intensively desired. In particular, the combination of a gold sensitization with a sulfur sensitization or with a selenium sensitization can provide a marked increase in sensitivity but at the same time the increase in fog is accompanied. The gold-selenium sensitization particularly increases a fog as compared with the gold-sulfur sensitization. Accordingly, there has been intensively desired development of the selenium sensitization in which a sensitivity change in storage is controlled and the generation of fog is suppressed. It is still more difficult to attain a merit of a high sensitivity with the above combination further with a reduction sensitization since it accelerates generation of fog. Further, in a chemical sensitization of tabular grains, it is difficult to control the chemical sensitization because a surface area thereof per volume is large, which results in the most difficulty to control generation of fog while increasing a sensitivity.

A light-sensitive material has been desired to be more sensitive and to be able to be rapidly processed, and therefore it has attempted to increase the sensitivity of a silver halide emulsion used therefor and accelerate the processing by reducing a binder amount. However, the increase in sensitivity to light and the reduction of the amount of binder (gelatin and a high molecular weight polymer) which serves as a protective colloid worsen properties of a light-sensitive material with respect to stress blackening and scratch-blackening. Further, generation of fog and desensitization during storage of a light-sensitive material are liable to take place as well.

There is a method known in the art that the blackening can be reduced by incorporating hydroquinone or a derivative thereof into a layer constituting a light-sensitive material, as described in, for example, JP-A-64-72141. Also, it is described in, for example, JP-A-2-280457 that hydroquinone having an adsorbing group for making it easy to adsorb to a silver halide grain and hydroquinone having an anti-diffusion group for improving an anti-diffusion property are effective for the purpose. Further it is described in, for example, JP-A59-97134 that a triazine compound and a derivative thereof are particularly effective for improving storability of tabular grains.

However, a hydroquinone compound and a derivative thereof are often used as a developing agent because of its high reducing property against Silver halide. Accordingly, it is supposed that silver in a high sensitive emulsion subjected to a chemical sensitization with a selenium sensitizer is reduced during storage and that an aging fog is liable to cause, as described in *Theory of Photographic Process,* Vol. 4, written by T. H, James et al.

SUMMARY OF THE INVENTION

An object of the present invention is to provide a silver halide photographic material having improved storage stability (an aging fog and desensitization) and anti-stress property, (a stress blackening) wherein a high sensitive silver halide emulsion subjected to a chemical sensitization with a selenium compound is used.

Another object of the present inventin is to provide a silver halide photographic emulsion particularly suitable for use in the above silver halide photographic material.

It has been found that the object can be attained by a silver halide photographic material comprising a support having provided thereon at least one light-sensitive silver halide emulsion layer containing a silver halide emulsion, wherein the silver halide emulsion has been subjected to a chemical sensitization with a selenium compound, and the silver halide emulsion layer or another layer provided on the support contains at least one of the compounds represented by formulas (I), (II) and (III):

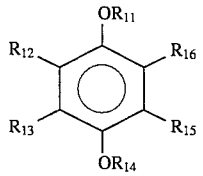

(I)

wherein $R_{12}$, $R_{13}$, $R_{15}$ and $R_{16}$ may be the same or different and each represents a hydrogen atom or a group substitutable to a benzene ring; $R_{11}$ and $R_{14}$ each represents a hydrogen atom or a protective group capable of being released in an alkaline condition; provided that $R_{12}$ to $R_{16}$, $OR_{11}$ and $OR_{14}$ may be combined with each other to form a ring;

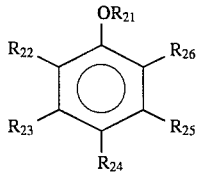

(II)

wherein $R_{22}$ to $R_{26}$ may be the same or different and each represents a hydrogen atom or a group substitutable to a benzene ring; $R_{21}$ represents a hydrogen atom or a protective group capable of being released in an alkaline condition; provided that $R_{22}$ to $R_{26}$ and $OR_{21}$ may be combined with each other to form a ring and that at least one of $R_{22}$ to $R_{26}$ is substituted with a group having a silver halide-adsorption accelerating group or a group having total carbon atoms of 6 or more, and at least one of $R_{22}$ to $R_{26}$ is substituted with a hydroxy group or a group capable of being released in an alkaline condition;

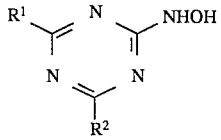

(III)

wherein $R^1$ and $R^2$ may be the same or different and each represents a hydroxy group, a hydroxylamino group, an amino group, an alkylamino group, an arylamino group, an aralkylamino group, an alkoxy group, a phenoxy group, an alkyl group, an aryl group, an alkylthio group, or a phenylthio group.

It has also been found that a silver halide photographic emulsion comprising tabular grains having an aspect ratio of 3 or more which account for at least 70% of the total projected area of the whole silver halide grains contained therein is particularly suitable for use in the above-mentioned silver halide photographic material, wherein the tabular grains are subjected to a selenium sensitization and a gold sensitization after a reduction sensitization.

DETAILED DESCRIPTION OF THE INVENTION

Formula (I) will be explained in more details.

Preferred examples of the group represented by $R_{12}$, $R_{13}$, $R_{15}$ and $R_{16}$ in formula (I) include an alkyl (linear, branched or cyclic), alkenyl, alkynyl, aralkyl, aryl, alkoxy, aryloxy, alkylthio, arylthio, carbonamide, sulfonamide, ureido, alkoxycarbonylamino, aryloxycarbonylamino, acyloxy, sulfamoylamino, sulfonyloxy, carbamoyl, sulfamoyl, acyl, sulfonyl, alkoxycarbonyl, or aryloxycarbonyl group having up to 30 carbon atoms, a halogen atom, a hydroxy group, a sulfo group, a carboxyl group, a cyano group, and a 3 to 12-membered heterocyclic group containing at least one of oxygen, nitrogen, sulfur, phosphorus, selenium and tellurium. These groups may further be substituted with the above mentioned groups.

Examples of the protective group represented by $R_{11}$ and $R_{14}$ in formula (I) are those having up to 25 carbon atoms and include an acyl group, an alkoxycarbonyl group, an aryloxycarbonyl group, a carbamoyl group, and further the groups described in JP-A-59-197037, 59-201057 and 59-108776.

Where $R_{12}$, $R_{13}$, $R_{15}$, $R_{16}$, $OR_{11}$ and $OR_{14}$ are combined with each other to form a ring, $R_{12}$ $OR_{11}$, $R_{12}$ and $R_{13}$, $R_{13}$ and $OR_{14}$, $R_{15}$ and $OR_{14}$, $R_{15}$ and $R_{16}$, or $R_{16}$ and $OR_{11}$ are preferably combined to form a saturated or unsaturated, 4 to 8-membered hydrocarbon ring or heterocyclic ring.

The compound represented by formula (I) may form a bis compound, a tris compound, an oligomer, or a polymer. $R_{12}$ to $R_{16}$ in formula (I) preferably have the total carbon atoms of 6 or more, preferably 8 or more.

Next, formula (II) will be explained.

The groups represented by $R_{22}$ to $R_{26}$ means the same groups defined for $R_{12}$, $R_{13}$, $R_{15}$, and $R_{16}$ in formula (I) and the protective group for $R_{21}$ to in formula (II) means the same groups defined for $R_{11}$ and $R_{14}$ in formula (II) means the same to $R_{26}$ and OR21 are combined with each other to form a ring, the same as in the above case of $R_{12}$ to $R_{16}$, $OR_{11}$ and $OR_{14}$ can be applied.

The silver-halide adsorption accelerating group for at least one of $R_{22}$ to $R_{26}$ in formula (II) is preferably represented by the formula:

$$Y—(L)_m—$$

wherein Y is a silver-halide adsorption accelerating group; L is a divalent linkage group; and m is 0 or 1. Preferred examples of the adsorption accelerating group include a thioamide group, a mercapto group, a group having a disulfide group, and a 5 to 6-membered nitrogen-containing heterocyclic group.

The thioamide type adsorption accelerating group represented by Y is a divalent group represented by -CS-amino- and may be a part of a cyclic structure, or may be a non-cyclic thioamide group. The useful thioamide type adsorption accelerating group can be selected from the groups described in, for example, U.S. Pat. Nos. 4,030,925, 4,031,127, 4,080,207, 4,245,037, 4,255,511, 4,266,013, and 4,276,364, and *Research Disclosure*, vol. 151, No. 15162 (November 1976) and vol. 176, No. 17626 (December 1978).

There can be given as examples of the non-cyclic thioamide group, a thioureido group, a thiourethane group, and a dithiocarbamic acid ester group. Also, examples of the cyclic thioamide group include 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-thiadiazoline-2-thione, 1,3,4-oxadiazoline-2-thione, benzimidazoline-2-thione, benzoxazoline-2-thione, and benzothiaazoline-2-thione. These groups may further be substituted.

The mercapto group represented by Y is an aliphatic mercapto group, an aromatic mercapto group, or a heterocyclic mercapto group (where a nitrogen atom is attached to a carbon atom to which a —SH group is bonded, it is the same as a cyclic thioamide group which has a tautomeric relationship therewith, and examples of this group are the same as those defined for the above cyclic thioamide group).

The 5 or 6-membered nitrogen-containing heterocyclic group for Y is a 5 or 6-membered nitrogen-containing heterocyclic group comprising the combination of nitrogen, oxygen, sulfur and carbon. Preferred are benzotriazole, triazole, tetrazole, indazole, benzimidazole, imidazole, benzothiazole, thiazole, benzoxazole, oxazole, thiadiazole, oxadiazole, and triazine. They may be substituted with suitable substituents.

Of the groups represented by Y as described above, preferred are a cyclic thioamide group (that is, a mercapto substituted nitrogen-containing heterocyclic group, for example, a 2-mercaptothiadiazole group, a 3-mercapto-1,2,4-triazole group, a 5-mercaptotetrazole group, a 2-mercapto-1,3,4-oxadiazole group, and a 2-mercaptobenzoxazole) and a nitrogen-containing heterocyclic group (for example, a benzotriazole group, a benzimidazole group and an indazole group).

Two or more Y—(L)m— groups may be present in formula (II) and may be the same or different.

The divalent linkage group represented by L is an atom or a group of atoms containing at least one of C, N, S and O. To be concrete, it comprises singly or the combination of, for example, an alkylene group, an alkenylene group, an arylene group, —O—, —S—, —NH—, —N=, —CO—, and —$SO_2$— (these groups may have substituents). Examples of the divalent linkage group are shown below.

CONH—, —NHCONH—, —$SO_2$NH—, —COO—,

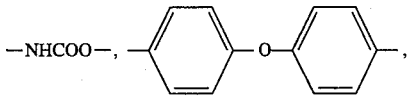

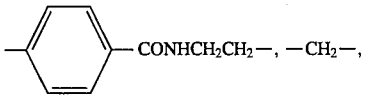

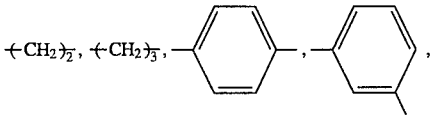

-continued

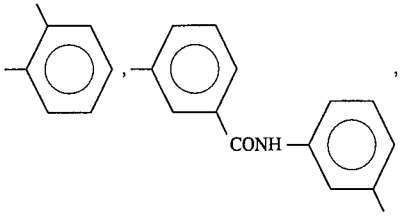

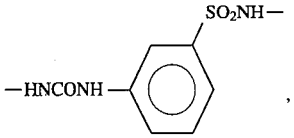

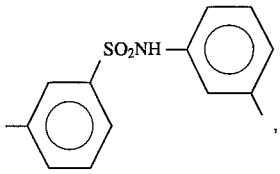

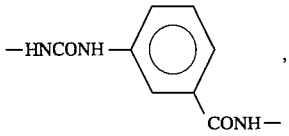

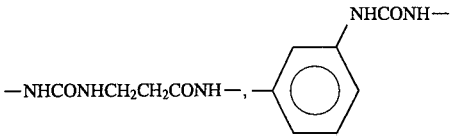

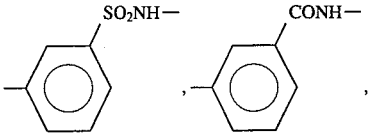

—$CH_2CH_2SO_2NH$—, —$CH_2CH_2CONH$—

Preferred examples of the compounds represented by formula (I) are shown below but not limited thereto:

1-1

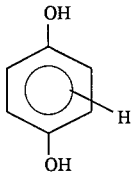

1-2

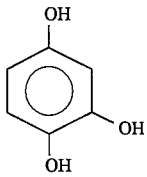

-continued
1-3
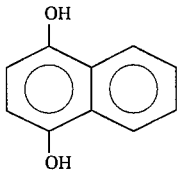
1-4
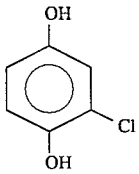
1-5
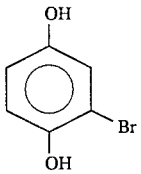
1-6
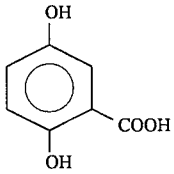
1-7
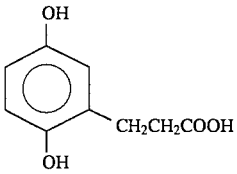
1-8
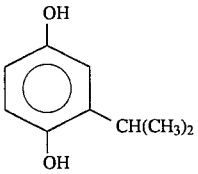
1-9
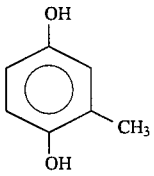
1-10
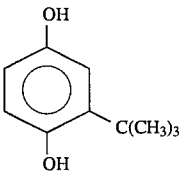
1-11
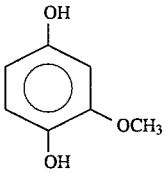
-continued
1-12
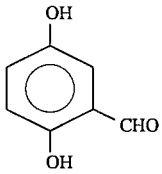
1-13
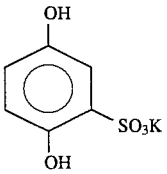
1-14
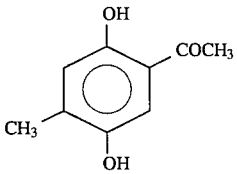
1-15
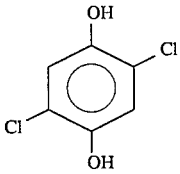
1-16
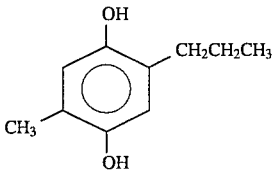
Preferred examples of the compounds represented by formula (II) are shown below but not limited thereto:
II-1
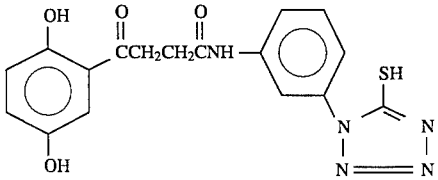
II-2
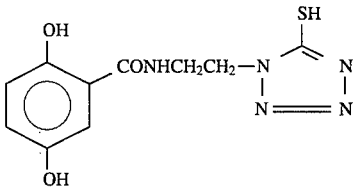
II-3
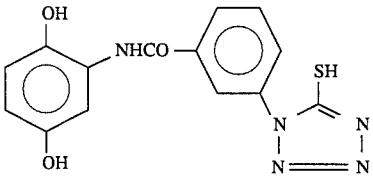

-continued
II-4
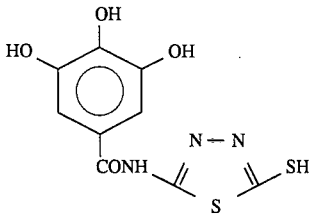
II-5
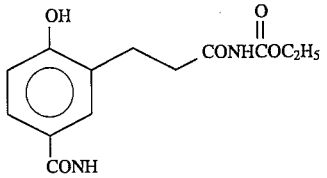
II-6
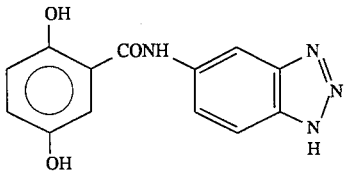
II-7
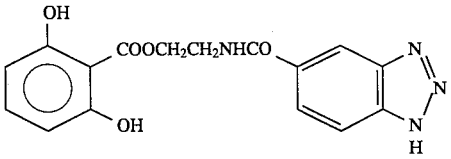
II-8
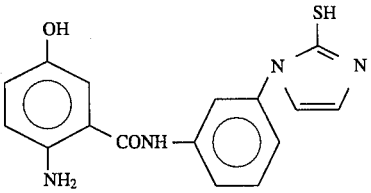
II-9
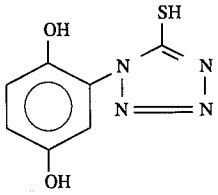
II-10
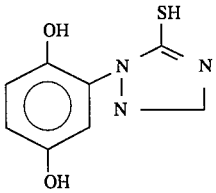
II-11
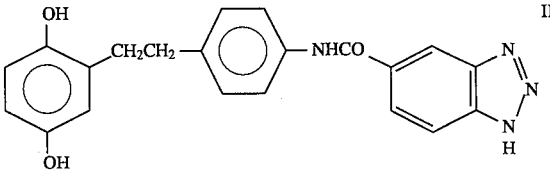
-continued
II-12
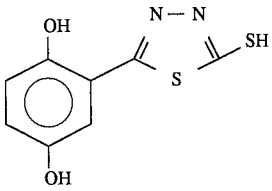
II-13
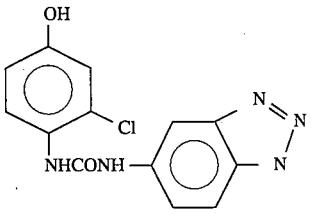
II-14
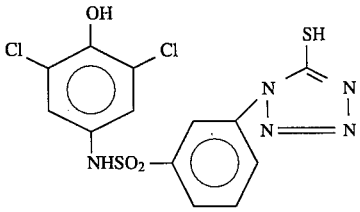
II-15
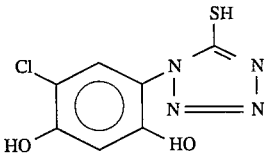
II-16
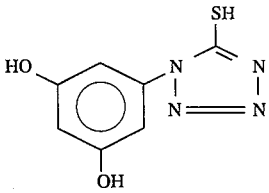
II-17
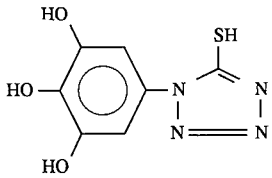
II-18
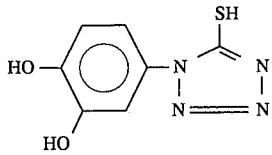
II-19
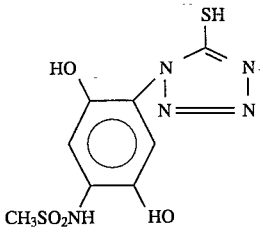

-continued
II-20
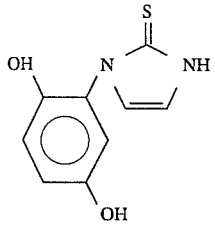
II-21
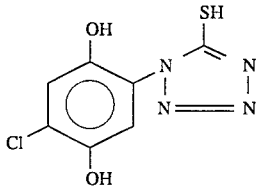
II-23
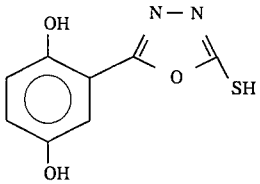
II-23
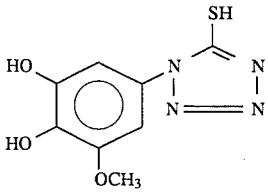
II-24
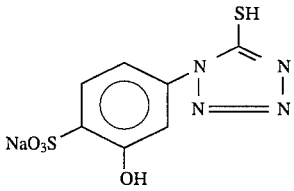
II-25
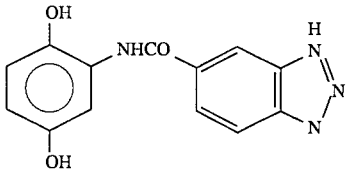
II-26
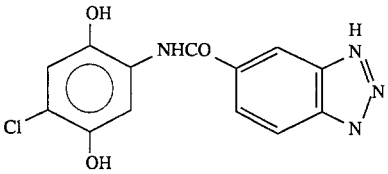
II-27
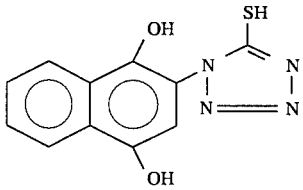
-continued
II-28
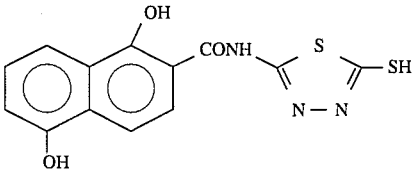
II-29
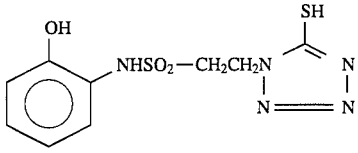
II-30
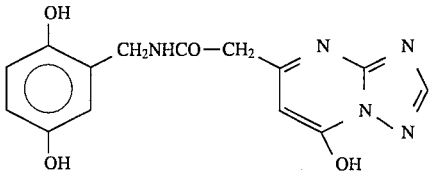
II-31
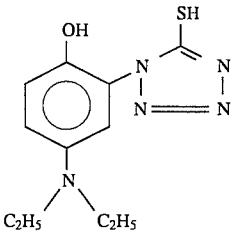
II-32
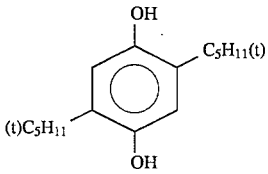
II-33
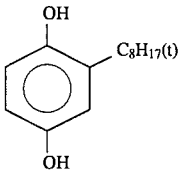
II-34
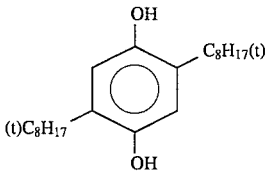
II-35
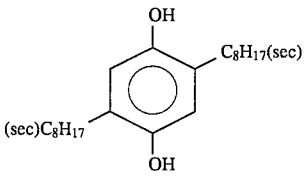
II-36
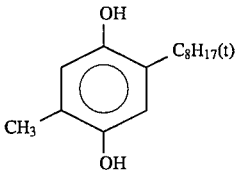

-continued

II-37

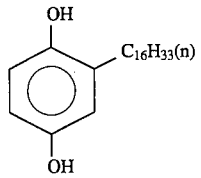

II-38

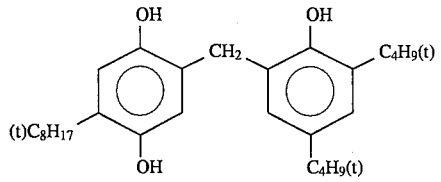

II-39

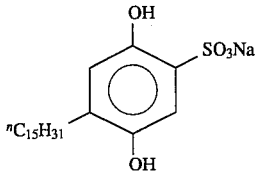

II-40

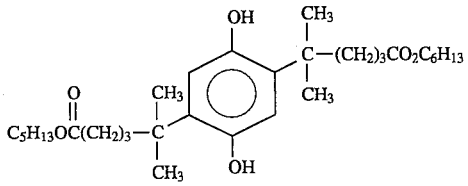

II-41

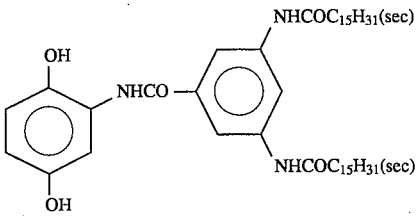

II-42

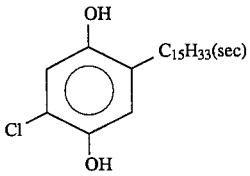

II-43

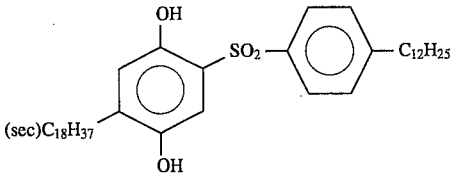

II-44

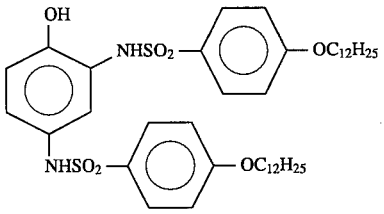

-continued

II-45

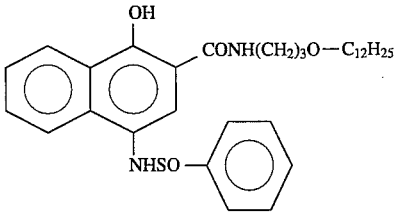

II-46

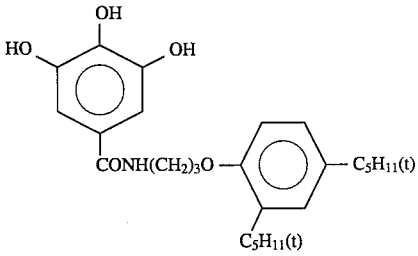

II-47

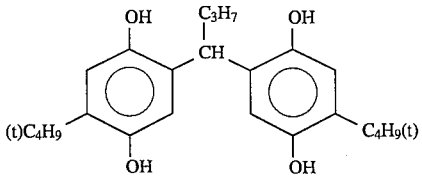

II-48

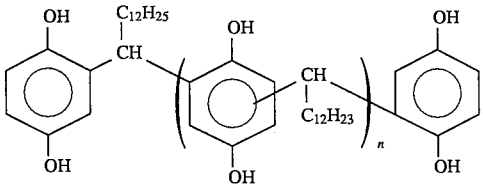

(n = 30 in average)

II-49

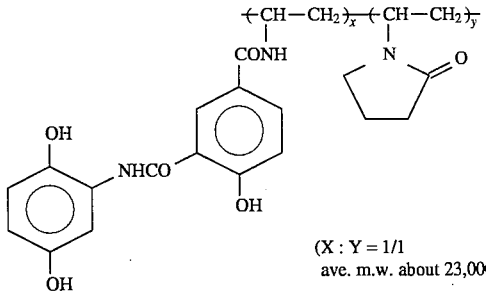

(X : Y = 1/1
ave. m.w. about 23,000)

The compounds represented by formula (I) and (II) according to the present invention can be synthesized by the methods described in the following patents and patents cited therein: U.S. Pat. Nos. 2,701,197, 3,700,453, 3,960,570, 4,232,114, 4,277,553, 4,443,537, 4,447,523, 4,476,219, 4,717,651, and 4,732,845, JP-B-51-12250, and JP-A-54-29637, 58-21249, 59-108776, 61-48456, 61-169844, and 61-309949.

The compounds represented by formulas (I) and (II) are preferably incorporated into a light-sensitive emulsion layer of the light-sensitive material. The addition amount of the compounds of formulas (I) and (II) is generally $1\times10^{-4}$ to 1 mole, preferably $1\times10^{-3}$ to $1\times10^{-1}$ mole per mole of silver halide.

Next, formula (III) will be explained in detail.

$R_1$ and $R_2$ may be the same or different and each represents a hydroxy group, a hydroxylamino group, an amino group, an alkylamino group (an amino group mono- or di-substituted with an alkyl group having preferably 1 to 5 carbon atoms), an aralkylamino group (having preferably 7 to 11 carbon atoms), an arylamino group (an amino group substituted with an aryl group having preferably 6 to 10 carbon atoms), an alkoxy group (preferably having 1 to 5 carbon atoms), a phenoxy group, an alkyl group (having preferably 1 to 5 carbon atoms), an aryl group (having preferably 6 to 10 carbon atoms), an alkylthio group (having preferably 1 to 5 carbon atoms), or a phenylthio group. An alkyl portion in each of the above groups may have a substituent such as a hydroxy group, an alkoxy group (having preferably 1 to 4 carbon atoms, particularly 1 to 2 carbon atoms), an amino group, and an alkylamino group (an amino group mono- or di-substituted with an alkyl group having preferably 1 to 4 carbon atoms, particularly 1 to 2 carbon atoms). Further, an aryl or phenyl portion in each of the groups represented by $R_1$ and $R_2$ may have a substituent such as a hydroxy group, an amino group, an alkylamino group (an amino group mono- or di-substituted with an alkyl group having preferably 1 to 4 carbon atoms, particularly 1 to 2 carbon atoms), an alkyl group (preferably having 1 to 4 carbon atoms, particularly 1 to 2 carbon atoms), and an alkoxy group (having preferably to 4 carbon atoms, particularly 1 to 2 carbon atoms).

Of the compounds represented by formula (III), particularly preferred are the compounds in which either one of $R_1$ and $R_2$ represents a hydroxylamino group and the other represents an alkylamino group and the compounds in which both of $R_1$ and $R_2$ represent an alkoxy group or an alkylamino group.

The compounds of formula (III) preferably used in the present invention are shown below but not limited threrto:

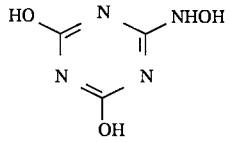
III-1

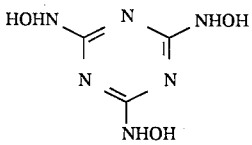
III-2

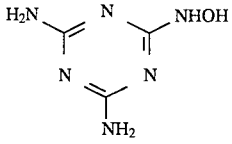
III-3

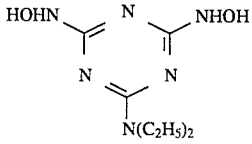
III-4

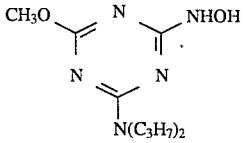
III-5

-continued

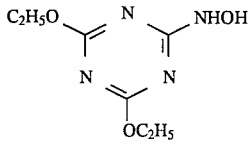
III-6

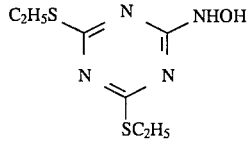
III-7

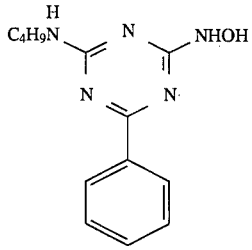
III-8

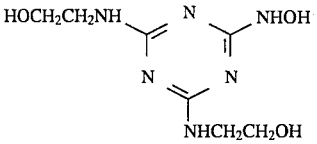
III-9

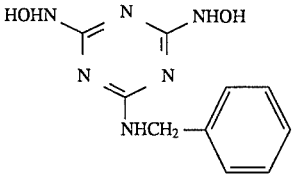
III-10

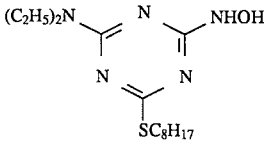
III-11

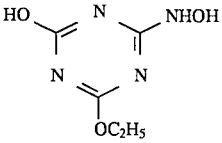
III-12

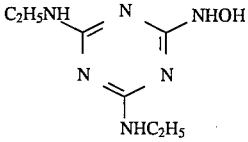
III-13

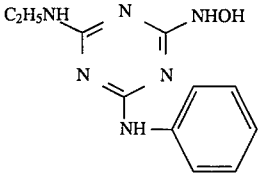
III-14

-continued

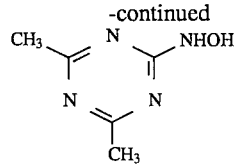
III-15

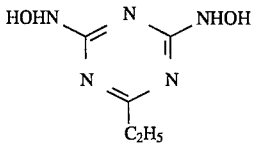
III-16

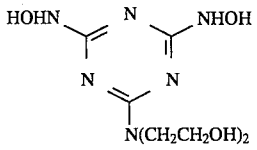
III-17

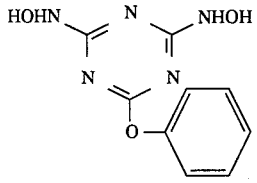
III-18

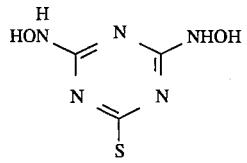
III-19

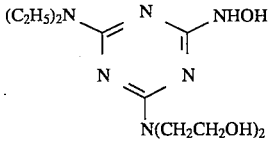
III-20

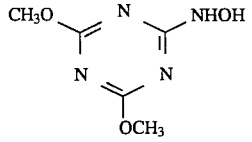
III-21

These compounds can be synthesized by the methods described in *Journal of Organic Chemistry*, vol. 27, pp. 4054 (1962), *Journal of the American Chemical Society*, vol. 73, pp. 2981 (1951), and JP-B-49-10692.

The compound of formula (III) is added as an aqueous solution, a hydrochloric acidic aqueous solution or a methanol solution to a photographic emulsion or a hydrophilic colloid solution used for forming a layer other than an emulsion layer (for example, an overcoating layer, a filter layer and an intermediate layer, preferably a layer adjacent to an emulsion layer containing the tabular silver halide grains). An addition timing is not specifically limited. When they are added to a photographic emulsion, they are suitably added after a chemical ripening and before coating. The an addition amount of the compound of formula (III) is preferably 0.01 to 10 g, more preferably 0.05 to 1 g per mole of silver.

As a selenium sensitizer, conventional selenium compounds can be used in the present invention, such as unstable type selenium compounds and/or stable type selenium compounds. They are added to a silver halide emulsion, followed by agitating at an elevated temperature, preferably 40° C. or higher for a predetermined time. Preferably used as the unstable selenium compound are the compounds described in JP-B-44-15748 and 43-13489, and JP-A-2-130976 and Japanese Patent Application No. Hei-2-229300. Such unstable selenium sensitizers include isoselenocyanates, selenoureas, selenoketones, selenoamides, selenocarboxylic acids, selenoesters, diacylselenides (for example, bis(3-chloro-2,6-dimethoxybenzoyl)selenide), selenides, selenophosphates, phosphineselenides, and colloidal metal selenium. In more detail, preferred unstable selenium compounds are shown below:

1. Colloidal metal selenium.
2. Organic selenium compound (a selenium atom is doubly bonded to a carbon atom of an organic compound via a covalent bond)

(a) isoselenocyanates: for example, aliphatic isoselenocyanate such as allylisoselenocyanate, (b) selenoureas (including an enol type): for example, aliphatic selenoureas containing methyl, ethyl, propyl, isopropyl, butyl, hexyl, octyl, dioctyl, tetramethyl, N-(b-carboxyethyl)-N',N'-dimethyl, N,N-dimethyl, diethyl, and dimethyl; aromatic selenourea having one or more aromatic groups such as phenyl and tolyl; and heterocyclic selenourea having a heterocyclic group such as pyridyl and benzothiazolyl, (c) selenoketones: for example, selenoacetone, selenoacetophenone, selenoketone in which an alkyl group is bonded to >C=Se, and selenobenzophenone, (d) selenoamides: for example, selenoacetamide, and (e) selenocarboxylic acids and esters thereof: for example, 2-selenopropionic acid, 2-selenobutyric acid, 3-selenobutyric acid, and methyl 3-selenobutylate.

3. Others (a) selenides: for example, diethylselenide, diethyldiselenide, and triphenylphosphineselenide, and (b) selenophosphates: for example, tri-p-tolylselenophosphate and tri-n-butylselenophosphate.

The preferred examples of the unstable selenium compound are not limited to those described above. For the unstable selenium compounds, the structures are not so important as long as the compounds are unstable, and it is generally understood that an organic portion of the selenium sensitizer has no any other roles than carrying selenium and making it exist in an emulsion in an unstable form. In the present invention, the unstable selenium compounds in such a broad sense can be used.

Also applied is a selenium sensitizing method in which the stable type selenium sensitizers described in JP-B-46-4553, 52-34492 and 52-34491 are used, such as selenious acid, potassium selenocyanide, selenazoles, quaternary ammonium salts of selenazoles, diarylselenide, diaryldiselenide, dialkylselenide, dialkyldiselenide, 2-thioselenazolidinedione, 2-selenoxolidinethione, and the derivatives thereof. Thioselenazolidinedione compounds (for example, 2-thioselenazolidinedione) and other selenium sensitizers as described in JP-B-52-38408 may also be used.

Particularly preferred selenium compounds are represented by formulas (IV) and (V):

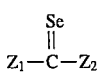
(IV)

wherein $Z_1$ and $Z_2$ may be the same or different and each represents an alkyl group (for example, methyl, ethyl, t-butyl, adamantyl, and t-octyl), an alkenyl group (for example, vinyl and propenyl), an aralkyl group (for example, benzyl and phenethyl), an aryl group (for example, phenyl, pentafluorophenyl, 4-chlorophenyl, 3-nitrophenyl, 4-octylsulfamoylphenyl, and α-naphthyl), a heterocyclic group (for example, pyridyl, thienyl, furyl, and imidazolyl), $—NR_1(R_2)$, $—OR_3$, and $—SR_4$; $R_1$, $R_2$, $R_3$ and $R_4$ may be the same or different and each represents an alkyl, aralkyl, aryl or heterocyclic group as those defined for $Z_1$ and may also be a hydrogen atom and an acyl group (for example, acetyl, propanoyl, benzoyl, heptafluorobutanoyl, difluoroacetyl, 4-nitrobenzoyl, α-naphthoyl, and 4-trifluoromethylbenzoyl);

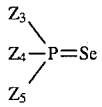

(V)

wherein $Z_3$, $Z_4$ and $Z_5$ may be the same or different and each represents an aliphatic group, an aromatic group, a heterocyclic group, —$OR_7$, —$NR_8(R_9)$, —$SR_{10}$, —$SeR_{11}$, X, or a hydrogen atom; $R_7$, $R_{10}$ and $R_{11}$ each represents an aliphatic group, an aromatic group, a heterocyclic group, a hydrogen atom, or a cation; $R_8$ and $R_9$ each represents an aliphatic group, an aromatic group, a heterocyclic group, or a hydrogen atom; and X represents a halogen atom.

In formula (IV), $Z_1$ preferably represents an alkyl group, an aryl group or —$NR_1(R_2)$ and $Z_2$ represents —$NR_5(R_6)$, wherein $R_1$, $R_2$, $R_5$ and $R_6$ may be the same or different and each represents a hydrogen atom, an alkyl group, an aryl group, or an acyl group. Of the compounds represented by formula (IV), more preferred are N,N-dialkylselenourea, N,N,N-trialkyl-N'-acylselenourea, tetralkylselenourea, N,N-dialkyl-arylselenoamide, and N-alkyl-N-aryl-arylselenoamide.

In formula (V), the aliphatic group represented by $Z_3$, $Z_4$, $Z_5$, $R_7$, $R_8$, $R_9$, $R_{10}$ and $R_{11}$ represents a linear, branched or cyclic alkyl group, an alkenyl group, an alkynyl group, or an aralkyl group, (for example, methyl, ethyl, n-propyl, isopropyl, t-butyl, n-butyl, n-octyl, n-decyl, n-hexadecyl, cyclopentyl, cyclohexyl, allyl, 2-butenyl, 3-pentenyl, propagyl, 3-pentynyl, benzyl, and phenethyl). The aromatic group represented by $Z_3$, $Z_4$, $Z_5$, $R_7$, $R_8$, $R_9$, $R_{10}$ and $R_{11}$ represents a monocyclic or condensed aryl group (for example, phenyl, pentafluorophenyl, 4-chlorophenyl, 3-sulfophenyl, α-naphthyl, and 4-methylphenyl). The heterocyclic group represented by $Z_3$, $Z_4$, $Z_5$, $R_7$, $R_8$, $R_9$, $R_{10}$ and $R_{11}$ represents a 3 to 10-membered saturated or unsaturated heterocyclic group containing at least one of a nitrogen atom, an oxygen atom and a sulfur atom (for example, a pyridyl group, a thienyl group, a furyl group, a thiazolyl group, an imidazolyl group, and a benzimidazolyl group).

In formula (V), the cation represented by $R_7$, $R_{10}$ and $R_{11}$ represents a an alkali metal atom or ammonium, and the halogen atom represented by X is, for example, a fluorine atom, a chlorine atom, a bromine atom or an iodine atom.

$Z_3$, $Z_4$ or $Z_5$ preferably represents an aliphatic group, an aromatic group or —$OR_7$, and $R_7$ preferably represents an aliphatic group or an aromatic group.

Of the compounds represented by formula (V), more preferred are trialkylphosphinegelenide, triarylphosphineselenide, trialkylselenophosphate, and triarylselenophosphate.

Examples of the Se compounds represented by formulas (IV) and (V) are shown below, but the present invention is not limited thereto.

1. 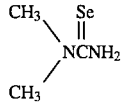

2. 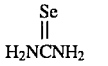

-continued

3. 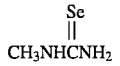

4. 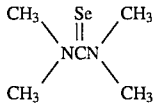

5. 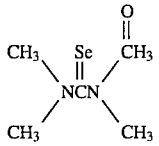

6. 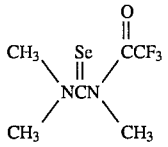

7. 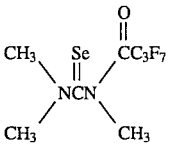

8. 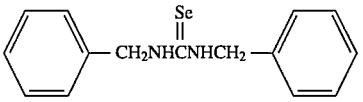

9. 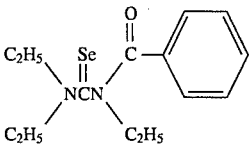

10. 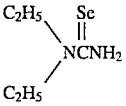

11. 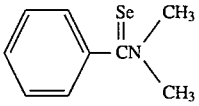

12. 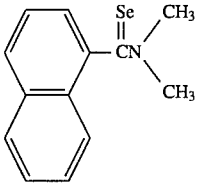

13. 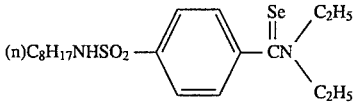

14. 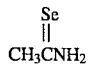

15. 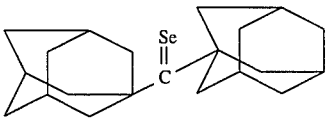

-continued

16.

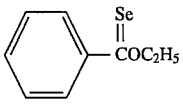

17.

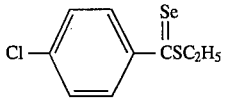

18.

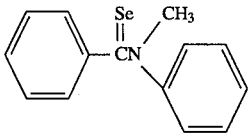

19.

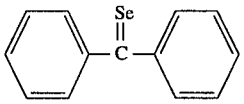

20.

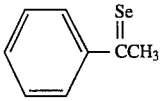

21.

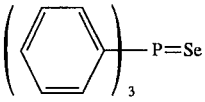

22.

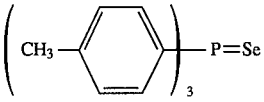

23.

$(nC_4H_9)_3P{=}Se$

24.

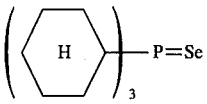

25.

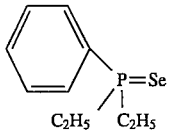

26.

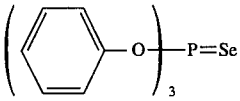

27.

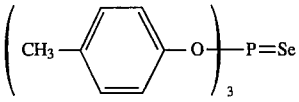

28.

$(nC_4H_9O)_3P{=}Se$

29.

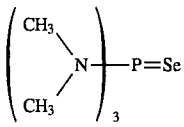

30.

$(C_2H_5O)_3P{=}Se$

-continued

31.

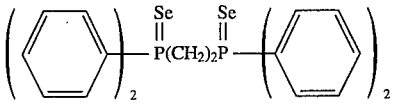

32.

$(nC_8H_{17}O)_3P{=}Se$

33.

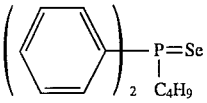

34.

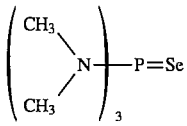

35.

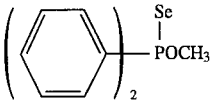

36.

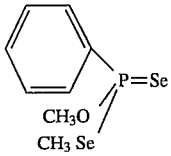

37.

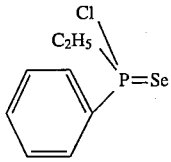

38.

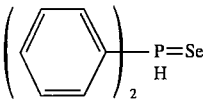

39.

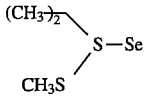

The selenium sensitizer is added during a chemical sensitization in the form of solution dissolved in water or a single or mixed solvent of organic solvents such as methanol and ethanol or in the form described in Japanese Patent Application Nos. Hei-2-264447 and 2-264448. The sensitizer is added preferably before starting a chemical sensitization. The selenium sensitizers used are not limited to a single kind and two or more kinds of the above selenium sensitizers can be used in combination. An unstable selenium compound and a stable selenium compound may be used in combination.

The addition amount of the selenium sensitizer used in the present invention varies depending on an activity of a selenium sensitizer used, a kind and a size of a silver halide grain, and a temperature and time of ripening. It is preferably $1\times10^{-8}$ mole or more, more preferably $1\times10^{-7}$ to $1\times10^{-5}$ mole per mole of silver halide. A temperature of a chemical ripening in applying a selenium sensitizer is preferably 45° C. or higher, more preferably 50° C. to 80° C. The pAg and the pH are arbitrary. For example, the effects of the present invention can be obtained in the range as broad as from 4 to 9 with respect to the pH.

The selenium sensitization is more effective when carried out in the presence of a silver halide solvent. As a silver halide solvent, (a) organic thioethers described in U.S. Pat. Nos. 3,271,157, 3,531,289, and 3,574,628, and JP-A-54-1019 and 54-158917; (b) thiourea derivatives described in JP-A-53-82408, 55-77737 and 55-2982; (c) a silver halide solvent having a thiocarbonyl group interposed between an oxygen atom or a sulfur atom and a nitrogen atom, described in JP-A-53-144319; (d) imidazoles described in JP-A-54-100717; (e) sulfites; and (f) thiocyanates can be used. Particularly preferred solvents are thiocyanate and tetramethylurea. The amount of the solvent used varies depending on the kind of solvents. For example, in case of thiocyanate, the preferred amount is $1\times10^{-4}$ to $1\times10^{-2}$ mole per mole of silver halide.

The silver halide photographic emulsion according to the present invention can achieve higher sensitivity and lower fog by using a sulfur sensitizer and/or a gold sensitizer in combination with the selenium sensitizer for the chemical sensitization.

A sulfur sensitization is usually carried out by adding a sulfur sensitizer to an emulsion and stirring it for a predetermined time at an elevated temperature, preferably 40° C. or higher. Known a sulfur sensitizers can be used for the sulfur sensitization, such as thiosulfate, thioureas (for example, allylthiocarbamidethiourea), allylisothiacyanate, cystine, p-toluenethiosulfonate, and rhodanine. In addition, sulfur sensitizers described in U.S. Pat. Nos. 1,574,944, 2,410,689, 2,278,947, 2,728,668, 3,501,313, and 3,656,955, German Patent 1,422,869, JP-B-56-24937, and JP-A-55-45016 may be used. The sulfur sensitizer may be added in an amount sufficient for effectively increasing sensitivity of an emulsion. This amount is varied over a wide range under various conditions such as pH, a temperature and a size of a silver halide grain. It is preferably $1\times10^{-7}$ to $5\times10^{-4}$ mole per mole of silver halide.

A gold sensitization is usually carried out by adding a gold sensitizer to an emulsion and stirring it for a predetermined time at an elevated temperature, preferably 40° C. or higher.

A gold sensitizer used for the gold sensitization may have an oxidation number of gold of either +1 valency or +3 valency, and conventional gold compounds can be used for the purpose. Representative examples include chloroaurate, potassium chloroaurate, auric trichloride, potassium auricthiocyanate, potassium iodoaurate, tetracyanoauric acid, ammonium aurothiocyanate, and pyridyl trichlorogold. The addition amount of the gold sensitizer varies depending on conditions. It is preferably $1\times10^{-7}$ to $5\times10^{-4}$ mole per mole of silver halide.

In carrying out the chemical sensitization, there are no particular limitation on the timing and order of adding a silver halide solvent and a selenium sensitizer or the timing and order of adding a sulfur sensitizer and/or gold sensitizer which can be used in-combination with the selenium sensitizer. The above compounds can be added simultaneously or at a different addition timing, for example, at an initial stage of a chemical ripening or during proceeding of the chemical ripening, but preferably at the initial stage. The above compounds can be added after dissolving in water or an organic solvent miscible with water, for example, methanol, ethanol and acetone.

The emulsion used in the present invention is preferably subjected to a reduction sensitization. A reduction sensitization can be carried out by using ascorbic acid and a derivative thereof, thiourea dioxide, stannous chloride, aminoiminomethanesulfinic acid, a hydrazine derivative, a borane compound, a silane compound, and a polyamine compound as a reducing agent, as described in JP-A-2-191938 and 2-136852 and JP-B-57-33572. Further, the reduction sensitization can be carried out by ripening while maintaining the pH at 7 or higher or the pAg at 8.3 or lower. Also, the reduction sensitization can be carried out by introducing a single addition of silver ions during the formation of grains. The reduction sensitization is preferably carried out preferably with ascorbic acid and a derivative thereof or thiourea dioxide in order to less affect a grain formation and a crystal growth and to control the reduction sensitization. The amount of a reduction sensitizer used varies depending on the kind of a reducing agent used, and it is preferably $1\times10^{-7}$ to $1\times10^{-2}$ mole/mole of Ag.

The reduction sensitization may be carried out at any stage during the grain formation, and it may be carried out even after the grain formation as long as it is before a chemical sensitization.

The forms of silver halide grains used in the present invention are not specifically limited, but tabular grains are preferably used from the viewpoint of improvement in a stress fog and a storability.

A grain size of the tabular grain emulsion preferably used in the present invention is 0.3 to 10 μm, preferably 0.3 to 5.0 μm, more preferably 0.3 to 2.0 μm, and particularly preferably 0.5 to 1.2 μm. A thickness of the grains is 0.05 to 0.3 μm, particularly 0.1 to 0.25 μm. An aspect ratio thereof (diameter/thickness ratio) is 3 to 100, preferably 4 to 50, more preferably 4 to less than 20, and particularly preferably 4 to less than 8. The tabular silver halide emulsion used in the present invention preferably contains tabular grains having an aspect ratio of 3 or more, accounting for 70% or more (in terms of a projected area), particularly 80% or more of the whole grains, and an average aspect ratio of the whole tabular grains is preferably 4 to 8. Of tabular silver halide grains, monodispersed hexagonal tabular grains are particularly useful. For the details of the structure and preparation-of the monodispersed hexagonal tabular grains, reference can be made to JP-A-63-151618.

The diameter of the above silver halide grains is defined by a diameter of the circle having the same area as a projected area of the grain. In general, the tabular silver halide grain is of a plate having two parallel planes. Accordingly, the "thickness" called in the present invention is defined by a distance between the two parallel planes constituting the tabular silver halide grain.

The composition of silver halide used in the present invention is preferably silver chlorobromoiodide, silver bromoiodide, silver bromide or silver bromochloride, with silver bromide and silver bromoiodide having a silver iodide content of 10 mole % or less being more preferred.

The tabular silver halide grains can be prepared in a conventional manner, as described in "Evolution of The Morphology of Silver Bromide Crystals During Physical Ripening" written by Cugnac and Chateau, published in *Science el Industrie Photography,* Vol. 33, pp. 121 to 125 (1962); *Photographic Emulsion Chemistry,* written by Duffin, published by Focal Press, New York, 1966, pp. 66 to 72; and *Photographic Journal.,* Vol. 80, pp. 285 (1940), written by A. P. H. Trivelli and W. F. Smith. It can be readily prepared with reference to the methods described in *Research Disclosure* Vol. 225, Item 22534, pp. 20 to 58 (January 1983), JP-A-58-113926, 58-127921, 58-113927, and 58-113928, and U.S. Pat. No. 4,439,520.

For example, it can be prepared by forming seed grains comprising 40% by weight or more of tabular grains at pBr of 1.3 or less and a relatively high pAg and adding simultaneously a silver salt solution and a halide solution while keeping the pBr value at the same level. In this grain growing step, the silver salt and halide solutions are preferably added such a manner that new crystal nuclei are not formed. The sizes of the tabular silver halide grains can be controlled by adjusting the temperature, selecting a kind and an amount of a solvent and adjusting an adding speed of the halides.

A silver halide solvent may be used in preparation of the tabular silver halide grains used in the present invention so as to control a grain size, a grain form (a diameter/thickness), a grain size distribution, and a growing speed of the grains. The amount of the solvent used is preferably 0.001 to 1.0% by weight, particularly preferably 0.01 to 0.1% by weight based on the reaction solution. For example, as the amount of the solvent increases, the grain size distribution can be made closer to a monodispersion and the growing speed of the grains can be accelerated. Further, the thickness of the grains tends to increase as the amount of the solvent increases. There can often be used as the silver halide solvent, ammonia, potassium rhodanide, ammonium rhodanide, thioether, thioureas (as described in, for example, U.S. Pat. Nos. 3,271,157, 3,790,387, 3,574,628, 3,704,130, 4,297,439, and 4,276,374), thione compounds (as described in, for example, JP-A-53-144319, 53-82408, and 55-77737), and amine compounds (as described in, for example, JP-A-54-10717).

In preparing the tabular silver halide grains, preferably used is a method to increase an addition speed, an addition amount and an addition concentration of a silver salt solution (for example, an $AgNO_3$ aqueous solution) and a halide solution (for example, a KBr aqueous solution), whereby the grain growth can be accelerated. These methods can be referred to the descriptions of British Patent 1,335,925, U.S. Pat. Nos. 3,672,900, 3,650,757, and 4,242,445, and JP-A-55-142329 and 55-158124.

The silver halide grains according to the present invention may have a layer structure in which the compositions of an inside and a surface portion are different, or a uniform structure. Also, they may be either the grains in which a latent image is formed primarily on the surface thereof (for example, a negative type emulsion), or the grains in which a latent image is formed primarily in the inside thereof (for example, an inner latent image type emulsion and a prefogged direct reversal type emulsion), with the former being preferred.

Silver halide grains may be formed or physically ripened in the present of a cadmium salt, a zinc salt, a thallium salt, an iridium salt or a complex salt thereof, a rhodium salt or a complex salt thereof, or an iron salt or a complex salt thereof.

Where silver bromoiodide and silver chlorobromoiodide are used as the emulsion used for the lihgt-sensitive material of the present invention, a relative standard deviation of the silver iodide content in the respective silver halide grains contained in the emulsions is preferably 20% or less in the respective emulsions. The above relative standard deviation exceeding 20% is not preferred since a fog is liable to increase and a gradation is liable to deteriorate.

In the case where a monodispersed emulsion is used in the present invention, the adding speeds of a silver nitrate aqueous solution and a water soluble halide aqueous solution can be accelerated as the silver halide grains grow in the preparation of the monodispersed emulsion. The acceleration of the adding speeds enables a grain size distribution to get closer to a monodispersion, and also it enables an addition time to shorten, which benefits-an industrial production. Further, it is preferable from a viewpoint of the reduction of the chance that a structural defect is formed in the silver halide grains.

For example, the adding speeds of a silver nitrate aqueous solution and a halide aqueous solution may be increased continuously or intermitently as described in JP-B-48-36890 and 52-16364, and JP-A-55-142329. An upper limit of the adding speeds may be just below the speed at which new grain formation comes to take place, and the value thereof depends on a temperature, pH, pAg, a stirring degree, a composition of silver halide grains, a solubility, a grain size, a distance between the grains, and a kind and concentration of protective colloid.

A method of preparing a monodispersed emulsion is well known and described in, for example, *J. Phot. Sci.*, vol. 12, pp. 242 to 251 (1963), JP-B-48-36890 and 52-16364, and JP-A-55-142329. Further, the technique described in JP-A-57-179835 can also be applied.

The silver halide emulsion used in the present invention may be a core/shell type monodispersed emulsion, which is well known and described in JP-A-54-48521. The silver halide emulsion may also be a polydispersed emulsion prepared by, a known method. For example, it can be prepared by applying a neutral method, an acidic method, an ammonia method, a regular mixing method, a reverse mixing method, a double jet method, a controlled-double jet method, a conversion method, and a core/shell method each described in *The Theory of the Photographic Process*, written by T. H. James, the 4th edition, pp. 38 to 104 (1977), published by Macmillan Co., Ltd.

It is preferred that a silver halide-adsorbing substance be present in an amount of 0.1 millimole or more per mole of silver halide in the reaction system after the completion of a reduction sensitization and before or during a chemical sensitization, as described in JP-A-2-68539. The silver halide-adsorbing substance may be added at any time during formation of the grains, immediately after formation of the grains, or before or after initiation of post-ripening. It is added preferably before addition of a chemical sensitizer (for example, gold and sulfur sensitizers) or at the same time as the addition of the chemical sensitizer. The silver halide-adsorbing substance is preferably present at least at the step of carrying out the chemical ripening, and it is preferably added under the condition at a temperature of 30° to 80° C., more preferably 50° to 80° C. for the purpose of strengthening the adsorbability, and a pH of 5 to 10 and a pAg 7 to 9, when added during the chemical sensitization.

The silver halide-adsorbing substance used herein means a sensitizing dye and a photographic property stabilizer. Examples include those known as an antifoggant or a stabilizer including azoles such as a benzothiazolium salt, a benzoimidazolium salt, imidazoles, benzoimidazoles, nitroindazoles, trizoles, benzotriazoles, tetrazoles, and triazines; mercapto compounds such as mercaptothiazoles, mercaptobenzothiazoles, mercaptoimidazoles, mercaptobenzimidazoles, mercaptobenzoxazoles, mercaptothiadiazoles, mercaptoxadiazoles, mercaptotetrazoles, mercaptotriazoles, mercaptopyrimidines, and mercaptotriazines; thioketo compounds such as oxazolinethions; azaindenes such as triazaindenes, tetrazaindenes (in particular, 4-hydroxy-substituted (1,3,3*a*,7) tetrazaindenes), and pentazaindenes.

Purines, nucleic acids or polymers described in JP-B-61-36213 and JP-A-59-90844 may also be used as adsorbing substance. Among them, the azaindenes, purines and nucleic acids are particularly preferably used in the present invention.

The addition amount of these compounds is 10 to 300 mg per mole of silver halide, preferably 20 to 200 mg per mole of silver halide.

Examples of the silver halide-adsorbing substance used in the present invention include a cyanine dye, a merocyanine dye, a complex cyanine dye, a complex merocyanine dye, a holopholar cyanine dye, a styryl dye, a hemicyanine dye, an oxonol dye, and a hemioxonol dye. The useful sensitizing dyes are described in, for example, U.S. Pat. Nos. 3,522,052, 3,619,197, 3,713,828, 3,615,643, 3,615,632, 3,617,293, 3,628,964, 3,703,3777, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632, and 2,503,776, JP-A-48-76525, and Belgian Patent 691,807. The addition amount of the sensitizing dye is 300 to less than 2000 mg per mole of silver halide, preferably 400to less than 1000 mg per mole of silver halide.

Examples of sensitizing dyes useful in the present invention are shown below:

1

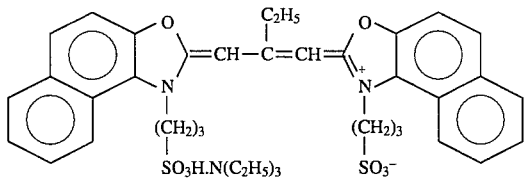

2

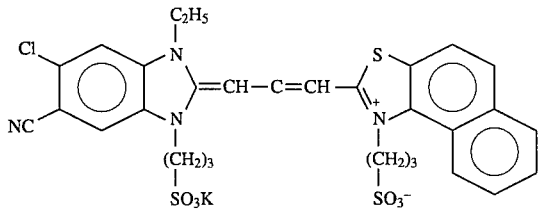

3

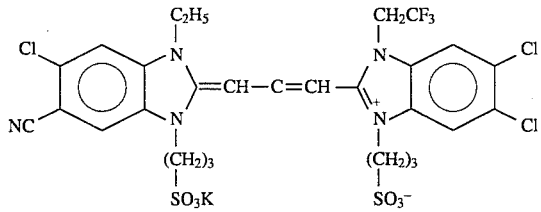

4

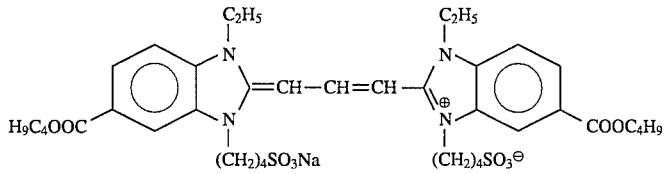

5

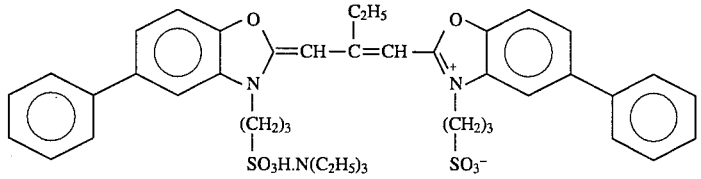

6

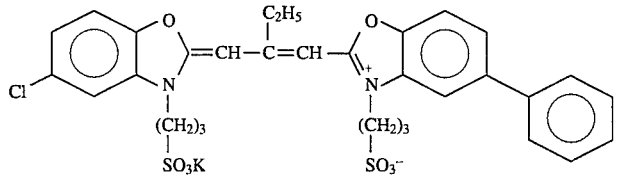

7

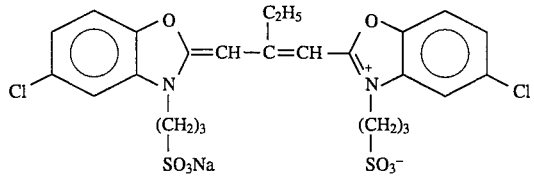

-continued

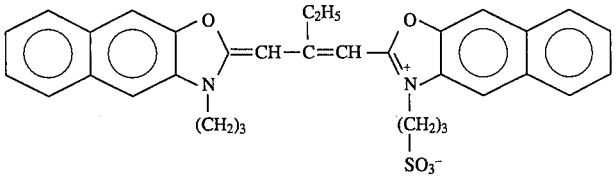

The tabular silver halide grains used in the present invention are preferably present in an amount of 50% by weight or more, particularly preferably 60% by weight or more of the whole grains contained in the emulsion layer. A thickness of the emulsion layer containing the tabular silver halide grains is preferably 0.3 to 5.0 μm, particularly preferably 0.5 to 3.0 μm. Also, a coated amount (per one side) of the tabular silver halide grains is preferably 0.5 to 6 g/m$^2$, particularly preferably 1 to 4 g/m$^2$.

Other components of the emulsion layer containing the tabular silver halide grains are not limited, and any known additives such as a hardener, an anti-fogging agent, a stabilizer for silver halide, a surface active agent, a spectral sensitizing agent, a dye, a UV absorber, and a chemical sensitizer can be contained. Reference can be made to, for example, *Research Disclosure,* vol. 176, pp. 22 to 28 (December 1978).

The photographic emulsions used in the present invention can contain various compounds for the purposes of preventing fog in preparing, storing and photographically processing a light-sensitive material or for the purpose of stabilizing the photographic properties. There can be added many compounds which are known as an anti-foggant and a stabilizer, such as azoles, for example, a benzothiazolium salt, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (in particular, 1-phenyl-5-mercaptoterazole); mercaptopyrimidines; azaindenes, for example, triazaindenes, tetrazaindenes (in particular, 4-hydroxy substituted (1,3,3*a*,7) tetrazaindenes), and pentaazaindenes; benzenethiosulfonic acid, benzenesulfinic acid, and benzenesulfonic acid amide. Those described in, for example, U.S. Pat. Nos. 3,954,474 and 3,982,947, and JP-B-52-28660 can also be used.

Another embodiment of the present invention is a silver halide emulsion containing tabular grains capable of providing a low fog, a high sensitivity and an excellent developability, which is suitable for use in the above-described silver halide photographic material.

The silver halide emulsion of this embodiment comprises tabular silver halide grains having an aspect ratio of 3 or more, which account for 70% or more of the whole grains and which are subjected to a chemical sensitization with a selenium sensitizer and a gold sensitizer and to a reduction sensitization prior to the chemical sensitization.

In particular, when the above emulsion is prepared, the thiosulfonic acid compounds represented by formulas (VI), (VII) and (VIII) can be preferably added at the grain formation step and/or chemical sensitization step, whereby the emulsion capable of providing a high sensitivity and a low fog can be obtained:

$$R—SO_2S—M \quad (VI)$$

$$R—SO_2S—R^1 \quad (VII)$$

$$R—SO_2S—Lm—SSO_2—R^2 \quad (VIII)$$

wherein R, $R^1$ and $R^2$ may be the same or different and each represents an aliphatic group, an aromatic group, or a heterocyclic group; M represents a cationic ion; L represents a divalent linkage group; and m represents 0 or 1.

The compounds of formulas (VI) to (VIII) may be the polymers having the linkage groups derived from the structures represented by formuals (VI) to (VIII) as a repetitive unit.

The amount of the thiosulfonic acid compound is preferably from $1\times10^{-6}$ to $1\times10^{-2}$ mole, more preferably from $1\times10^{-5}$ to $1\times10^{-3}$ mole, per mole of silver halide.

The compounds represented by formulas (VI) to (VIII) are known as an anti-fogging agent, and it is described in, for example, JP-A-2-191938 and 2-136852 that the combined use thereof with a reduction sensitizer provides an emulsion capable of providing a low fog and a high sensitivity. However, no concrete examples have been reported in which the compounds represented by formulas (VI) to (VIII) are applied to an emulsion which is subjected to a reduction sensitization and further to a selenium sensitization and a gold sensitization. It is quite difficult to expect that these compounds prevent fog and increase sensitivity of the specific emulsion. In the present invention, however, the combined use thereof has made it possible to obtain marked effects.

Examples of the compounds represented by formulas (VI) to (VIII) are shown below:

$$CH_3SO_2SNa \quad (6\text{-}1)$$

$$C_2H_5SO_2SNa \quad (6\text{-}2)$$

$$C_3H_7SO_2SK \quad (6\text{-}3)$$

$$C_4H_9SO_2SLi \quad (6\text{-}4)$$

$$C_6H_{13}SO_2SNa \quad (6\text{-}5)$$

$$C_8H_{17}SO_2SNa \quad (6\text{-}6)$$

$$CH_3(CH_2)_3\underset{\underset{C_2H_5}{|}}{C}HCH_2SO_2S.\ NH_4 \quad (6\text{-}7)$$

$$C_{10}H_{21}SO_2SNa \quad (6\text{-}8)$$

$$C_{12}H_{25}SO_2SNa \quad (6\text{-}9)$$

$$C_{16}H_{33}SO_2SNa \quad (6\text{-}10)$$

$$(CH_3)_2CH—SO_2SK \quad (6\text{-}11)$$

$$t\text{-}C_4H_9SO_2SNa \quad (6\text{-}12)$$

$$CH_3OCH_2CH_2SO_2S.Na \quad (6\text{-}13)$$

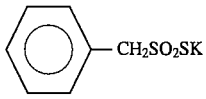

(6-14)

-continued $CH_2=CHCH_2SO_2SNa$ (6-15)

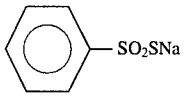
(6-16)

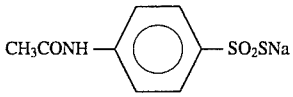
(6-17)

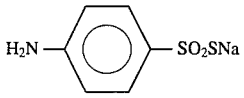
(6-18)

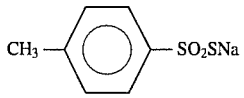
(6-19)

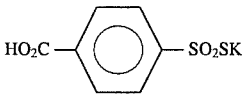
(6-20)

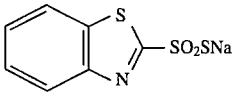
(6-21)

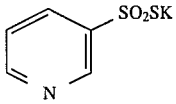
(6-22)

$C_2H_5SO_2S-CH_3$ (7-1)

$C_8H_17SO_2SCH_2CH_3$ (7-2)

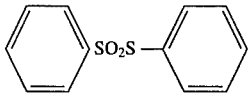
(7-3)

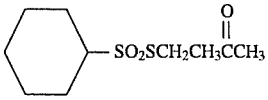
(7-4)

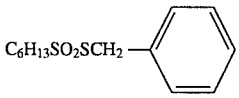
(7-5)

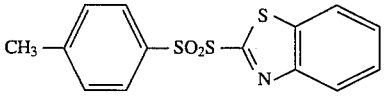
(7-6)

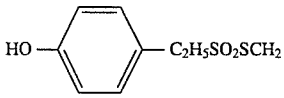
(7-7)

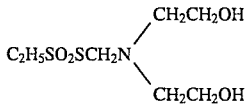
(7-8)

-continued

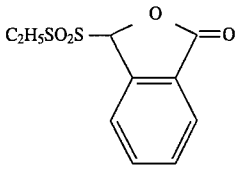
(7-9)

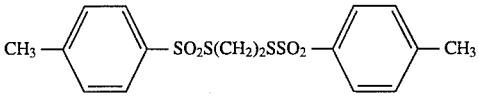
(8-1)

$C_2H_5SO_2SCH_2CH_2SO_2CH_2CH_2SSO_2C_2H_5$ (8-2)

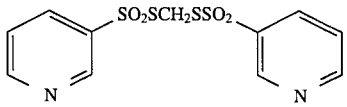
(8-3)

$n\text{-}CH_8H_{17}SO_2SSSO_2C_8H_{17}\text{-}n$ (8-4)

Where the emulsion of the above embodiment is used in the silver halide photographic material, at least one of the compounds represented by formula (IX) can preferably be added to the emulsion layer or another hydrophilic colloid layer having a water-permeability relationship with the emulsion layer such that water can permeate in the hydrophilic colloid layer through the emulsion layer or vice versa, whereby a light-sensitive material having further improved properties with respect to fog, sensitivity and developability can be obtained.

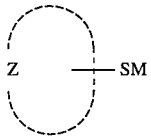
(IX)

In formula (IX), Z represents a heterocyclic group having at least one of $—SO_3M$, $—COOR_1$, —OH and $—NHR_2$ directly or indirectly bonded thereto; M represents a hydrogen atom, an alkali metal atom, a quaternary ammonium group, or a quaternary phosphonium group; $R_1$ represents a hydrogen atom, an alkali metal atom, or an alkyl group having 1 to 6 carbon atoms; $R_2$ represents a hydrogen atom, an alkyl group having 1 to 6 carbon atoms, $—COR_3$, $—COOR_3$, or $—SO_2R_3$; and $R_3$ represents a hydrogen atom, an aliphatic group, or an aromatic group.

The amount of the compound of formula (IX) is preferably $1\times10^{-5}$ mole or more per mole of silver halide.

As described above, the compounds represented by formula (IX) are incorporated into the layer containing the silver halide emulsion which is subjected to a selenium sensitization, a gold sensitization and a reduction sensitization, or to another hydrophilic colloid layer having a water-permeability relationship therewith. The "water-permeability relationship" means that the layers can have the mutual relationship in which water can permeate therethrough under an alkaline atmosphere in a development processing. The hydrophilic colloid layer includes other emulsion layers contacting directly or indirectly the emulsion layer, an intermediate layer, an anti-color mixing layer, an anti-halation layer, a filter layer, and a protective layer, but a protective layer and others provided on an opposite side of a support are not included.

A hydrophilic colloid layer typically contains gelatin, modified gelatin, and a hydrophilic vinyl polymer such as polyvinyl alcohol singly or as a mixture.

Next, the compounds represented by formula (IX) will be explained.

Z in formula (IX) is a heterocyclic group to which at least one of —$SO_3M$, —$COOR_1$, —OH and $NHR_2$ is directly or indirectly bonded, (e.g., an oxazole ring, a thiazole ring, an imidazole ring, a selenazole ring, a triazole ring, a tetrazole ring, a thiadiazole ring, an oxadiazole ring, a pentazole ring, a pyrimidine ring, a thiazine ring, a triazine ring, and a thiodiazine ring), or a ring fused with another hydrocarbon ring and heterocyclic ring (e.g., a benzothiazole ring, a benzotriazole ring, a benzimidazole ring, a benzoxazole ring, a benzoselenazole ring, a naphthoxazole ring, a triazaindolizine ring, a diazaindolizine ring, and a tetrazaindolizine ring. Preferred are an imidazole ring, a tetrazole ring, a benzimidazole ring, a benzothiazole ring, a benzoxazole ring, and a triazole ring).

M in formula (IX) represents a hydrogen atom, an alkali metal atom, a quaternary ammonium group, or a quaternary phosphonium group. $R_1$ represents a hydrogen atom, an alkali metal atom, or an alkyl group having 1 to 6 carbon atoms; $R_2$ represents a hydrogen atom, an alkyl group having 1 to 6 carbon atoms, —$COR_3$, —$COOR_3$, or —$SO_2R_3$; and $R_3$ represents a hydrogen atom, an aliphatic group, or an aromatic group. These groups may further have the substituents.

Examples of the compounds represented by formula (IX) are shown below:

(1)

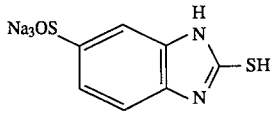

(2)

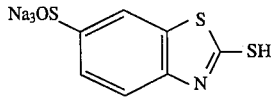

(3)

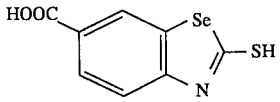

(4)

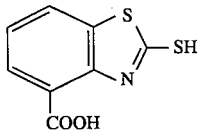

(5)

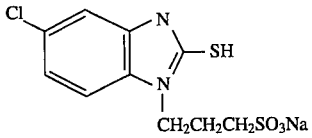

(6)

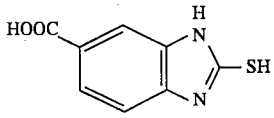

(7)

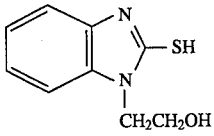

-continued (8)

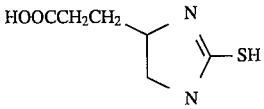

(9)

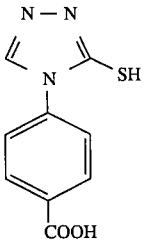

(10)

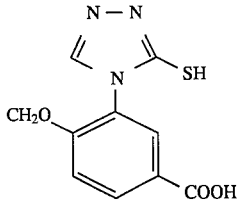

(11)

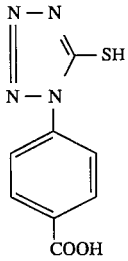

(12)

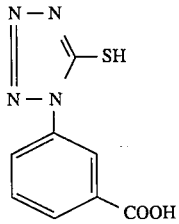

(13)

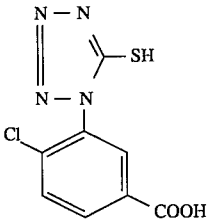

(14)

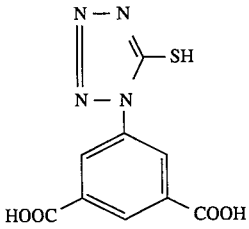

-continued
(15)
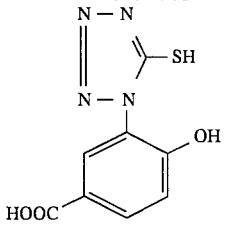
(16)
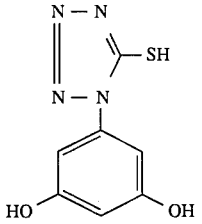
(17)
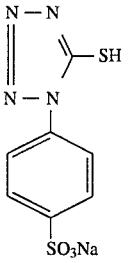
(18)
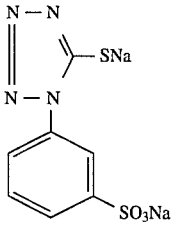
(19)
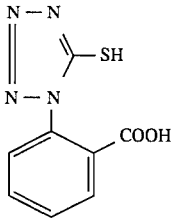
(20)
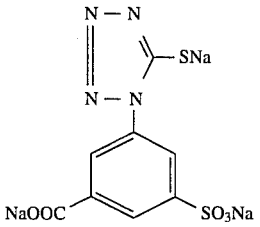
(21)
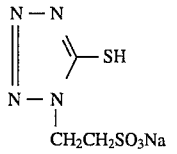
-continued
(22)
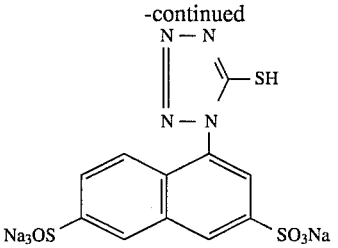
(23)
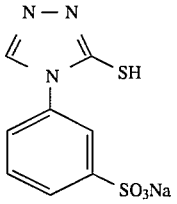
(24)
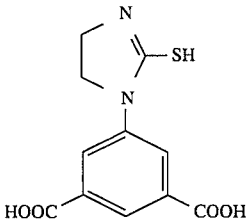
(25)
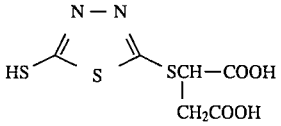
(26)
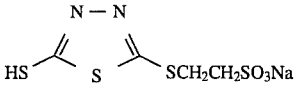
(27)
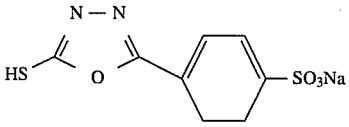
(28)
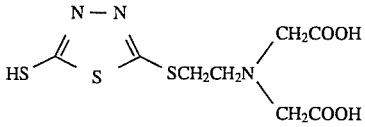
(29)
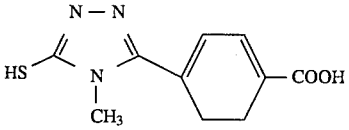
(30)
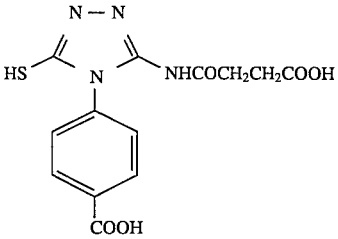
(31)
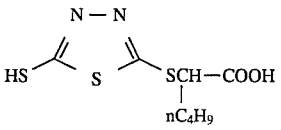

-continued

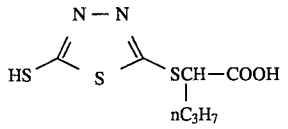

(32)

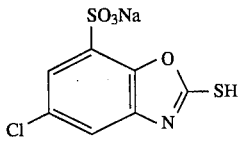

(33)

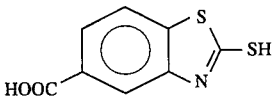

(34)

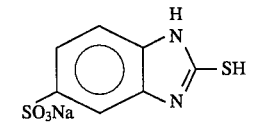

(35)

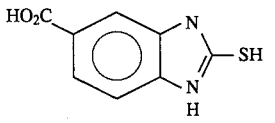

(36)

The compounds of formula (IX) are known and can be synthesized by the methods described in the following documents: U.S. Pat. Nos. 2,585,388 and 2,541,924, JP-B-42-21842, JP-A-53-50169, British Patent 1,275,701, *Journal of Heterocyclic Chemistry,* D. A. Berges et al, vol. 15, No. 981 (1978), *The Chemistry of Heterocyclic Chemistry., Imidazole and Derivatives part* 1, pp. 336 to 339, *Chemical Abstract,* 58, No. 7921 (1963), pp, 394, *Journal of Chemical Society,* E. Hoggarth, pp. 1160 to 1167 (1949), *Organic Fractional Group Preparation,* S. R. Saudler and W. Karo, Academic Press Co., pp. 312 to 315 (1968), *Bulletin de la Societe Chimique de France,* M. Chamdon et al, 723(1954), *J. Amer. Chem. Soc.,* D. A. Shirley and D. W. Alley, 79, 4922 (1954), *Ber.*(German chemical magazine), A. Wohl and W. Marchwald, vol. 22, pp. 568 (1889), *J. Amer. Chem. Soc.* 44, pp. 1502 to 1510, U.S. Pat. No. 3,017,270, British Patent 940,169, JP-B-49-8334, JP-A-55-59463, *Advanced in Hetercyclic Chemistry,* German Patent 2,716,707, *The Chemistry of Heterocyclic Compounds Imidazole and Derivatives,* vol. 1, pp. 385, *Org. Synth. IV,* 569 (1963), *Ber.* 9, 465 (1976), *J. Amer. Chem. Soc.* 45, 2390 (1923), JP-A-50-89034, 53-28426, and 55-21007, and JP-B-40-28496.

The compound represented by formula (IX) is incorporated into a silver halide emulsion layer or a hydrophilic colloid layer (an intermediate layer, a surface protective layer, a yellow filter layer, and an anti-halation layer), and preferably into a silver halide emulsion layer or a layer adjacent thereto. The addition amount thereof is preferably $1\times10^{-5}$ to $1\times10^{-1}$ g/m$^2$, more preferably $5\times10^{-5}$ to $1\times10^{-2}$ g/m$^2$, particularly preferably $1\times10^{-4}$ to $5\times10^{-3}$ g/m$^2$. Usually, the compounds represented by formula (IX) can be used in the range of $1\times10^{-5}$ to $1\times10^{-1}$ mole, preferably $1\times10^{-5}$ to $8\times10^{-3}$ mole per mole of silver halide subjected to a selenium sensitization, a gold sensitization and a reduction sensitization.

The addition of this compound to an emulsion may be carried by a conventional method as in the case of addition of photographic emulsion additives. For example, it is dissolved in methyl alcohol, ethyl alcohol, methyl cellosolve, acetone, water, or a mixed solvent thereof and then added in a solution. The compound of formula (IX) can be added at any step in the preparation of a photographic emulsion and at any stage after preparing an emulsion and immediately before coating.

The silver halide photographic emulsion of the present invention can be prepared by the methods described in, for example, *Research Disclosure* (RD) No. 17643 (December 1978), pp. 22 to 23, "I. Emulsion Preparation and Types", and No. 18716 (November 1979), pp. 648, *Chimie et Physique Photographique,* written by P. Glafkides, published by Paul Montel Co. (1967), *Photographic Emulsion Chemistry,* written by G. F. Duffin, published by Focal Press Co. (1966), and *Making and Coating Photographic Emulsion,* written by V. L. Zelikman et al, published by Focal Press Co. (1964).

Monodispersed emulsions described in U.S. Pat. Nos. 3,574,628 and 3,655,394, and British Patent 1,413,748 are also preferably used in the present invention.

The crystal structure may be uniform or of a structure in which a halogen composition is different in an inside and a surface, or of a stratum structure. Further, silver halides of different compositions may be conjugated with an epitaxial conjunction. Also, it may be of a structure in which silver halide is conjugated with the compounds other than silver halide, for example, silver rhodanide and lead oxide. Further, the mixture of the grains having the different crystal forms may be used.

Silver halide emulsions which are subjected to a physical ripening, a chemical ripening and a spectral sensitization are generally used. Additives for the emulsions are described in *Research Disclosure* No. 17643 and No. 18716. Various additives and development processing methods which are particularly preferably used for the light-sensitive material of the present invention are described in, for example, the following corresponding portions of JP-A-2-68539:

| Item | Corresponding portions |
|---|---|
| 1. Silver halide emulsion and the production method thereof | 6th line from bottom, right lower colmn on p.8 to 12th line, right upper colmn on p.10. |
| 2. Chemical sensitizing method | 13th line, right upper column to 16th line, left lower colmn on p.10. |
| 3. Antifoggant and stabilizer | 17th line, left lower colmn on p.10 to 7th line, left upper colmn on p.11, and 2nd line, left lower colmn on p.3 to left lower colmn on p.4. |
| 4. Spectral sensitizing dye | 4th line, right lower colmn on p.4 to right lower colmn on p.8 |
| 5. Surfactant and anti-electrification agent | 14th line, left upper colmn on p.11 to 9th line, left upper colmn on p.12. |
| 6. Matting agent, lublicant and plasticizer | 10th line, left upper colmn to 10th line, right upper colmn on p.12; 10th line, left lower colmn to 1st line, right lower colmn on p.14. |
| 7. Hydrophilic colloid | 11th line, right upper colmn to 16th line, left lower colmn on p.12 |
| 8. Hardener | 17th line, left lower colmn on p.12 to 6th line, right upper colmn on p.13. |
| 9. Support | 7th to 20 lines, right upper colmn on p.13. |
| 10. Dye and mordant | 1st line, left lower colmn on p.13 to 9th line, left lower colmn on p.14. |
| 11. Development | JP-A-2-103037: 7th line, |

-continued

| Item | Corresponding portions |
|---|---|
| | right upper colmn on p.16 to 15th line, left lower colmn on p.19; JP-A-2-115837: 5th line, right lower colmn on p.3 to 10th line, right upper colmn on p.6. |

The present invention will be explained in details with reference to the examples.

EXAMPLE 1

To 1 liter of water containing 4.5 g of potassium bromide, 20.6 g of gelatin and 2.5 ml of a 5% aqueous solution of thioether $HO(CH_2)_2S(CH_2)_2S(CH_2)_2OH$, were added 37 ml of a silver nitrate aqueous solution (silver nitrate: 3.43 g) and 33 ml of an aqueous solution containing 2.97 g of potassium bromide and 0.363 g of potassium iodide by a double jet method for 37 seconds while stirring at 60° C. Next, an aqueous solution containing 0.9 g of potassium bromide was added and then 53 ml of a silver nitrate aqueous solution (silver nitrate: 4.90 g) was added over a period of 13 minutes after the temperature was increased to 70° C. 15 ml of a 25% ammonia aqueous solution was added to conduct a physical ripening for 20 minutes while keeping the temperature as it was, followed by adding 14 ml of a 100% acetic acid solution.

Subsequently, an aqueous solution containing 133.3 g of silver nitrate and an aqueous solution containing potassium bromide were added by a controlled double jet method over a period of 35 minutes while maintaining the pAg to 8.5. Then, 10 ml of a 2N potassium thiocyanate aqueous solution was added. After conducting a physical ripening for 5 minutes while keeping that temperature, the temperature was then lowered to 35° C. Thus, there were obtained monodispersed tabular grains having a total silver iodide content of 0.26 mole %, an average projected area-corresponding circle diameter of 1.10 μm, a thickness of 0.165 mm, and a diameter fluctuation coefficient of 18.5%.

Soluble salts were removed from the thus-obtained emulsion by a settling method. The temperature was raised again to 40° C., and 30 g of gelatin, 2.35 g of phenoxy ethanol, and 0.8 g of poly-sodium styrenesulfonate as a thickener were added to the emulsion, followed by adjusting the pH and the pAg to 5.90 and 8.25, respectively, with caustic soda and silver nitrate.

This emulsion was then subjected to sensitization while stirring and keeping the temperature at 56° C. That is, first, 0.043 mg of thiourea dioxide was added and the emulsion was allowed to stand for 22 minutes to conduct a reduction sensitization. Then, 20 mg of 4-hydroxy-6-methyl-1,3,3*a*,7-tetrazaindene and 500 mg of a sensitizing dye of the following chemical structure were added.

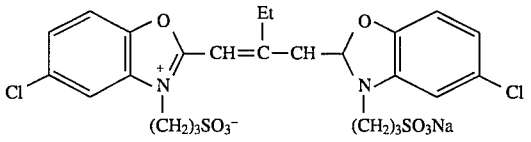

Further, 0.83 g of calcium chloride was added, and subsequently 3.3 mg of sodium thiosulfate, 2.6 mg of chlorauric acid and 90 mg of potassium thiocyanate were added to conduct a chemical sensitization. 40 minutes thereafter, the emulsion was cooled to 35° C. Thus, silver halide tabular grain emulsion T-1 was.

Tabular grain emulsions T-2, T-3 and T-4 were prepared in the same manner as in the preparation of emulsion T-1, except that 3.3 mg of sodium thiosulfate was replaced with the chemical sensitizers shown in Table 1.

TABLE 1

| Emulsion | Chemical sensitizer | Amount |
|---|---|---|
| T-1 | Sodium thiosulfate | 3.3 mg |
| T-2 | Sodium thiosulfate | 1.3 mg |
| | Se compound 21 | 2.7 mg |
| T-3 | Se compound 21 | 4.5 mg |
| T-4 | Sodium thiosulfate | 2.0 mg |
| | Se compound 1 | 0.8 mg |

Preparation of coating solution

The additives shown in Table 2 and the following compounds per mole of silver halide were added to each of emulsions T-1 to T-4 to prepare Samples 1 to 13 for coating.

Gelatin (including gelatin in an emulsion) 65.6 g

Trimethylol propane 9 g

Dextrane (average molecular weight: 39,000) 18.5 g

Poly-sodium styrenesulfonate 1.8 g (average molecular weight: 600,000)

Hardener (1,2-bis(vinylsulfonylacetamide) ethane; an addition amount was adjusted so that a swelling ratio became 230%.

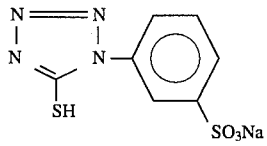

34 mg

TABLE 2

| Sample No. | Emulsion | Compound | Additive Amount |
|---|---|---|---|
| 1 (Comp.) | T-1 | — | — |
| 2 (Comp.) | T-1 | II-9 | 0.5 mg/m$^2$ |
| 3 (Comp.) | T-1 | II-15 | 50 mg/m$^2$ |
| 4 (Comp.) | T-1 | I-13 | 2.4 mg/m$^2$ |
| 5 (Comp.) | T-2 | — | — |
| 6 (Inv.) | T-2 | II-15 | 50 mg/m$^2$ |
| 7 (Inv.) | T-2 | II-13 | 2.4 mg/m$^2$ |
| 8 (Comp.) | T-3 | — | — |
| 9 (Inv.) | T-3 | II-9 | 0.5 mg/m$^2$ |
| 10 (Inv.) | T-3 | I-13 | 2.4 mg/m$^2$ |
| 11 (Comp.) | T-4 | — | — |
| 12 (Inv.) | T-4 | II-15 | 50 mg/m$^2$ |
| 13 (Inv.) | T-4 | I-13 | 2.4 mg/m$^2$ |

A surface protective layer coating solution containing the following components was prepared such that the coated amounts of the respective components became as shown below.

| Surface protective layer: | |
|---|---|
| Gelatin | 0.966 g/m$^2$ |
| Poly-sodium acrylate (average molecular weight: 400,000) | 0.023 g/m$^2$ |
| 4-Hydroxy-6-methyl-1,3,3a,7-tetrazaindene | 0.015 g/m$^2$ |

-continued

| Surface protective layer: | |
|---|---|
| 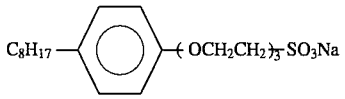 | 0.013 g/m$^2$ |
| $C_{16}H_{33}O(CH_2CH_2O)_{10}H$ | 0.045 g/m$^2$ |
| $C_{17}H_{33}CON(CH_3)CH_2CH_2SO_3Na$ | 0.0065 g/m$^2$ |
| $C_8F_{17}SO_2N(C_3H_7)(CH_2CH_2O)_{10}H$ | 0.003 g/m$^2$ |
| $C_8F_{17}SO_2N(C_3H_7)(CH_2CH_2O)_4(CH_2)_4SO_3Na$ | 0.001 g/m$^2$ |
| Polymethyl methacrylate (average grain size: 3.7 mm) | 0.087 g/m$^2$ |
| Proxel (adjusted pH to 7.4 with NaOH) | 0.0005 g/m$^2$ |

Preparation of a support (1) Preparation of dye dispersion D-1 for coating a subbing layer.

The dye having the following chemical structure was pulverized with a ball mill in the manner as described in JP-A-63-197943.

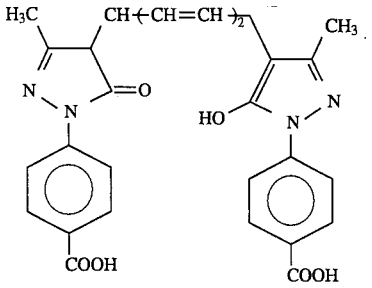

434 ml of water and 791 ml of a 6.7% aqueous solution of a surface active agent (Triton X-200 (TX-200)) were put in a 2-liter ball mill, and 20 g of the dye was added to this solution. 400 ml of beads (diameter: 2 mm) of zirconium oxide (ZrO) were put therein and the content was crashed for 4 days. Then, 160 g of a 12.5% gelatin solution was added and after deforming, and the mixture was filtered to remove the ZrO beads. Observation of the dye dispersion thus obtained showed that the particle sizes of the crashed dye were distributed in a wide range of 0.05 to 1.15 μm and that an average particle size thereof was 0.37 μm.

The dye particles having the sizes of 0.9 μm or more were removed from the dispersion with a centrifugal procedure. Thus, dye dispersion D-1 was obtained.

(2) Preparation of support.

A biaxially stretched polyethylene terephthalate film having a thickness of 183 μm was subjected to a corona discharge treatment, and the first subbing layer coating solution having the following composition was coated thereon with a wire bar coater so that a coated amount became 5.1 ml/m$^2$, followed by drying at 175° C. for one minute. The same first subbing layer was also provided on the opposite side of the support in the same manner. The polyethylene terephthalate as used above contained 0.04 wt % of the dye having the following chemical structure.

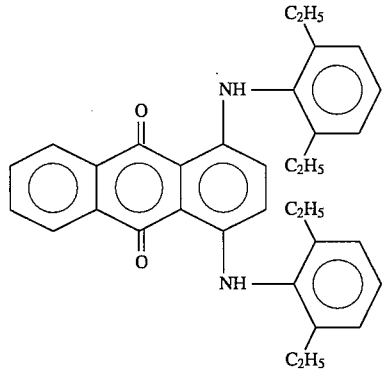

Containing solution for first subbing layer:

Butadiene-styrene copolymer latex solution (solid content: 40%, butadiene/styrene weight ratio: 31/69) 79 ml Sodium 2,4-dichloro-6-hydroxy-s-trazine (4% solution )20.5 ml Distilled water 900.5 ml Dispersant having the following chemical structure in an amount of 0.4 wt % of the solid content of the latex solution

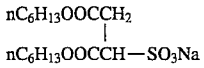

The second subbing layers having the following composition were applied on the first subbing layers layer, respectively, with a wire bar coater followed by drying at 150° C. The coated amounts of the respective components (on each surface) became as shown below..

| Second subbing layer: | |
|---|---|
| Gelatin | 160 mg/m$^2$ |
| Dye dispersion D-1 (as a solid content) | 26 mg/m$^2$ |
| 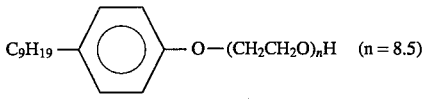 | 8 mg/m$^2$ |
| 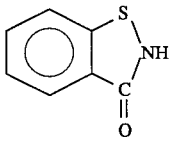 | 0.27 mg/m$^2$ |
| Matting agent (polymethyl methacrylate with an average grain size of 2.5 mm) | 2.5 mg/m$^2$ |

Preparation of light-sensitive material

The foregoing emulsion and surface protective layer coating solution were applied on both sides of the support prepared above by a simultaneous extrusion method. The coated silver amount per one side was set at 1.75 g/m$^2$.

Processings of light-sensitive material

The light-sensitive material, Samples 1 to 13, were exposed to light from both sides for 0.05 second using an X ray ortho screen HR-4 manufactured by Fuji Photo Film Co., Ltd. to evaluate sensitivity. After exposing to light, the respective samples were subjected to the following processings. The samples subjected to a folding test before light-exposure were also prepared.

Processings

The processings were carried out using an automatic development machine (a modified machine of SRX 501 manufactured by Konica Corp., in which a driving motor and a gear portion were modified to increase a carrying speed).

The developing tank and the fixing tank in the automatic development machine were filled with the following processing solutions before starting the development processing.

Developing tank: 333 ml of the following condensed developing solution 667 ml of water, and 10 ml of a starter containing 2 g of potassium bromide and 1.8 g of acetic acid were put and the pH was adjusted to 10.25.

Fixing tank: 200 ml of the following condensed fixing solution and 800 ml of water were placed.

Processing speed: Dry to Dry: 35 seconds.

Developing temperature: 35° C.

Fixing temperature: 32° C.

Drying temperature: 55° C.

Replenishing amount: developing solution 22 ml/10×12 inch, fixing solution 30 ml/10×12 inch.

Condensed development solution

Potassium hydroxide 56.6 g

Sodium sulfite 200 g

Diethylenetriaminepentacetic acid 6.7g

Potassium carbonate 16.7 g

Boric acid 10g

Hydroquinone 83.3 g

Diethylene glycol 40 g

4-Hydroxymethyl-4-methyl-1-phenyl-3-pyrazolidone 22.0 g

5-Methylbenzotriazole 2 g

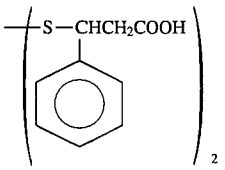

Water added to make 1 liter (pH adjusted to 10.60)

Condensed fixing solution

Ammonium thiosulfate 560 g

Sodium sulfite 60 g

Disodium ethylenediaminetetracetate dihydrate 0.10 g

Sodium hydroxide 24 g

Water added to make 1 liter (pH adjusted to 5.10)

Evaluation of the photographic property and anti-stress property

The sensitivity of the samples mesured is a relative value of a reciprocal of an exposure necessary to give a density of 1.0, taking that of Sample 1 as being 100.

A stress blackening was evaluated by a folding test, wherein grade 1 was given to a sample having a little blackening and grade 5 was given to a sample having the maximum blackening to thereby classify the stress blackening property into five grades.

The evaluation of the photographic property and stress blackening property are shown in Table 3.

TABLE 3

| Sample No. | Sensitivity | Stress blackening |
|---|---|---|
| 1 (Comp.) | 100 | 5 |
| 2 (Comp.) | 80 | 3 |
| 3 (Comp.) | 90 | 4 |
| 4 (Comp.) | 100 | 2 |
| 5 (Comp.) | 150 | 5 |
| 6 (Inv.) | 110 | 2 |
| 7 (Inv.) | 130 | 2 |
| 8 (Comp.) | 160 | 5 |
| 9 (Inv.) | 130 | 2 |
| 10 (Inv.) | 130 | 2 |
| 11 (Comp.) | 155 | 5 |
| 12 (Inv.) | 120 | 2 |
| 13 (Inv.) | 150 | 2 |

As apparent from from the results summarized in Table 3, it is seen that the light-sensitive materials of the present invention show a very little stress blackening, yet having a high sensitivity.

EXAMPLE 2

To 1 liter of water containing 4.5 g of potassium bromide, 20.6 g of gelatin, and 2.5 ml of a 5% aqueous solution of thioether $HO(CH_2)_2S(CH_2)_2S(CH_2)_2OH$, were added 37 ml of a silver nitrate aqueous solution (silver nitrate: 3.43 g) and 33 ml of an aqueous solution containing 2.97 g of potassium bromide and 0.363 g of potassium iodide by the double jet method for 37 seconds while stirring at 60° C. Next, an aqueous solution containing 0.9 g of potassium bromide was added, and the temperature of the mixture was raised to 70° C. Then, 53 ml of a silver nitrate aqueous solution (silver nitrate: 4.90 g) was added thereto over a period of 13 minutes. 15 ml of a 25% ammonia aqueous solution 15 ml was further added to conduct physical ripening for 20 minutes while keeping the temperature as it was, followed by adding 14 ml of a 100% acetic acid solution (the foregoing procedure is the same as in preparation of emulsion T-1).

Subsequently, an aqueous solution containing 133.3 g of silver nitrate and a mixed aqueous solution containing potassium bromide and potassium iodide were added by the controlled double jet method over a period of 35 minutes while maintaining the pAg at 8.1. Potassium iodide consumed herein was 0.2 mole % based on the whole silver amount contained in the finished silver halide grains. Then, 10 ml of a 2N potassium thiocyanate aqueous solution and 0.20 mole %, based on the whole silver amount, of AgI fine grains having a diameter of 0.07 μm were added. After conducting a physical ripening for 5 minutes while keeping the temperature as it was, the temperature was lowered to 35° C. Thus, there were obtained the monodispersed tabular grains having a total silver iodide content of 0.46 mole %, an average projected area-corresponding circle diameter of 1.15 μm, a thickness of 0.162 μm, and a diameter fluctuation coefficient of 20.5%.

Soluble salts were removed from the thus obtained emulsion by a settling method. The temperature was raised again to 40° C., and 30 g of gelatin, 2.35 g of phenoxy ethanol, and 0.8 g of poly-sodium styrenesulfonate as a thickener were added thereto, followed by adjusting the pH and the pAg to 5.90 and 8.25, respectively, with caustic soda and silver nitrate.

This emulsion was subjected to sensitization while stirring and keeping the temperature at 56° C. That is, first, 0.043 mg of thiourea dioxide was added and the emulsion was allowed to stand for 22 minutes to conduct a reduction sensitization. Then, 20 mg of 4-hydroxy-6-methyl-1,3,3*a*,7-tetrazaindene and 500 mg of the sensitizing dye as used in the preparation of emulsion T-1 were added. Further, 0.83 g of calcium chloride was added and subsequently 3.3 mg of sodium thiosulfate, 2.6 mg of chlorauric acid and 90 mg of potassium thiocyanate were added, and 40 minutes later, the resulting emulsion was cooled to 35° C. Thus, emulsion T-5 was prepared.

Emulsion T-6 was prepared in the same manner as in the preparation of emulsion T-5, except that 3.3 mg of sodium thiosulfate was replaced with 1.3 mg of sodium thiosulfate and 2.7 mg of the selenium compound 21.

Emulsion T-7 was also prepared in the following manner. Monodispersed silver bromoiodide tetradecahedral emulsion having an average grain size of 0.3 μm and a silver iodide content of 1.0 mole % was prepared by the double jet method while controlling pAg and pH at 8.6 and 5.0, respectively. A fluctuation coefficient of this emulsion was 12% in terms of a circle-corresponding diameter. This emulsion was subjected to the desalting and washing treatments in the same manner as in the preparation of emulsion T-5, and then it was subjected to sensitization while maintaining the temperature at 56° C. and stirring. That is, first 0.020 mg of thiourea dioxide was added and the emulsion was allowed to stand for 22 minutes to conduct a reduction sensitization. Then, 10 mg of 4-hydroxy-6-methyl-1,3,3*a*,7-tetrazaindene and 300 mg of the sensitizing dye as used for preparing T-1 were added. Further, 0.83 g of calcium chloride was added and subsequently 2.2 mg of the selenium compound 21, 1.3 mg of chlorauric acid and 0.6 g of potassium thiocyanate were added, and 50 minutes later, the resulting emulsion was cooled to 35° C. Thus, emulsion T-7 was prepared. Further, emulsion T-8 was prepared in the same manner as in the preparation of emulsion T-7, except that the selenium compound-21 was replaced with 0.8 mg of sodium thiosulfate and 1.1 mg of the selenium compound 21 for the chemical sensitization.

Emulsions T-5, T-6, T-7 and T-8 were coated in the same manner as Example 1, except that the gelatin coated amounts were changed as shown in Table 4 and that the additives shown in Table 5 were added, whereby the coated Samples 14 to 29 were prepared.

TABLE 4

| | Gelatin amount |
|---|---|
| Coating solution | 1.03 g/m$^2$ (Example 1: 1.14 g/m$^2$) |
| Surface Protective layer | 1.15 g/m$^2$ (Example 1: 1.78 g/m$^2$) |

TABLE 5

| Sample No. | Emulsion | Compound | Amount |
|---|---|---|---|
| 14 (Comp.) | T-5 | — | — |
| 15 (Comp.) | T-5 | II-9 | 0.5 mg/m$^2$ |
| 16 (Comp.) | T-5 | II-15 | 50 mg/m$^2$ |
| 17 (Comp.) | T-5 | I-13 | 2.5 mg/m$^2$ |
| 18 (Comp.) | T-6 | — | — |
| 19 (Inv.) | T-6 | II-9 | 50 mg/m$^2$ |
| 20 (Inv.) | T-6 | I-15 | 2.4 mg/m$^2$ |
| 21 (Inv.) | T-6 | I-13 | 2.5 mg/m$^2$ |
| 22 (Comp.) | T-7 | — | — |
| 23 (Inv.) | T-7 | II-9 | 0.5 mg/m$^2$ |
| 24 (Inv.) | T-7 | II-15 | 50 mg/m$^2$ |
| 25 (Inv.) | T-7 | I-13 | 2.5 mg/m$^2$ |
| 26 (Comp.) | T-8 | — | — |
| 27 (Inv.) | T-8 | II-9 | 0.5 mg/m$^2$ |

TABLE 5-continued

| Sample No. | Emulsion | Compound | Amount |
|---|---|---|---|
| 28 (Inv.) | T-8 | II-15 | 50 mg/m$^2$ |
| 29 (Inv.) | T-8 | I-13 | 2.5 mg/m$^2$ |

These samples were subjected to the tests of photographic sensitivity and stress blackening property in the same manner as in Example 1.

TABLE 6

| Sample No. | Sensitivity | Stress blackening |
|---|---|---|
| 14 (Comp.) | 100 | 5 |
| 15 (Comp.) | 90 | 4 |
| 16 (Comp.) | 100 | 4 |
| 17 (Comp.) | 98 | 3 |
| 18 (Comp.) | 130 | 5 |
| 19 (Inv.) | 125 | 2 |
| 20 (Inv.) | 130 | 2 |
| 21 (Inv.) | 133 | 2 |
| 22 (Comp.) | 105 | 5 |
| 23 (Inv.) | 100 | 3 |
| 24 (Inv.) | 110 | 3 |
| 25 (Inv.) | 112 | 2 |
| 26 (Comp.) | 110 | 5 |
| 27 (Inv.) | 105 | 3 |
| 28 (Inv.) | 110 | 3 |
| 29 (Inv.) | 112 | 2 |

As apparent from the results shown in Table 6, it is seen that the light-sensitive materials of the present invention show a high sensitivity and an excellent anti-stress blackening property.

EXAMPLE 3

Samples 30 to 51 were prepared in the same manner as in the preparations of Samples 1, 3, 5, 7, 9, and 13 in Example 1 and Samples 13, 14, 16, 17, 18, 20, 21, 22, 24, 27, and 29 in Example 2, except that the additives shown in Table 7 were further added.

TABLE 7

| Sample No. | Coating procedure | Compound | Amount |
|---|---|---|---|
| 30 (Comp.) | 1 | III-4 | 7 mg/m$^2$ |
| 31 (Comp.) | 3 | III-4 | 7 mg/m$^2$ |
| 32 (Inv.) | 5 | III-4 | 7 mg/m$^2$ |
| 33 (Inv.) | 7 | III-4 | 7 mg/m$^2$ |
| 34 (Inv.) | 9 | III-4 | 7 mg/m$^2$ |
| 35 (Inv.) | 13 | III-4 | 7 mg/m$^2$ |
| 36 (Comp.) | 17 | III-4 | 7 mg/m$^2$ |
| 37 (Inv.) | 18 | III-4 | 7 mg/m$^2$ |
| 38 (Inv.) | 21 | III-4 | 7 mg/m$^2$ |
| 39 (Inv.) | 22 | III-4 | 7 mg/m$^2$ |
| 40 (Inv.) | 24 | III-4 | 7 mg/m$^2$ |
| 41 (Inv.) | 29 | III-4 | 7 mg/m$^2$ |
| 42 (Comp.) | 1 | III-13 | 1.6 mg/m$^2$ |
| 43 (Comp.) | 3 | III-13 | 1.6 mg/m$^2$ |
| 44 (Inv.) | 5 | III-13 | 1.6 mg/m$^2$ |
| 45 (Inv.) | 7 | III-13 | 1.6 mg/m$^2$ |
| 46 (Inv.) | 9 | III-13 | 1.6 mg/m$^2$ |
| 47 (Comp.) | 14 | III-13 | 1.6 mg/m$^2$ |
| 48 (Comp.) | 16 | III-13 | 1.6 mg/m$^2$ |
| 49 (Inv.) | 20 | III-13 | 1.6 mg/m$^2$ |
| 50 (Inv.) | 21 | III-13 | 1.6 mg/m$^2$ |
| 51 (Inv.) | 27 | III-13 | 1.6 mg/m$^2$ |

The coated samples thus prepared were processed 5 days after coating and after leaving for standing at the environment of 30° C. and 60% RH for 12 months, respectively. The samples were processed in the same conditions as Example 1 and the sensitometry was measured in the same manner as Example 1 to obtain the results shown in Table 8. The sensitivity is a relative value taking that of Sample 1 of Example 1, as being 100.

TABLE 8

| | Sensitivity | | Fog | |
|---|---|---|---|---|
| Sample No. | Fresh | After aging*2 | Fresh*1 | After aging*2 |
| 30 (Comp.) | 100 | 80 | 0.07 | 0.15 |
| 31 (Comp.) | 90 | 60 | 0.07 | 0.14 |
| 32 (Inv.) | 150 | 140 | 0.08 | 0.10 |
| 33 (Inv.) | 130 | 135 | 0.08 | 0.10 |
| 34 (Inv.) | 130 | 140 | 0.08 | 0.10 |
| 35 (Inv.) | 150 | 135 | 0.08 | 0.10 |
| 36 (Comp.) | 120 | 155 | 0.08 | 0.13 |
| 37 (Inv.) | 155 | 150 | 0.08 | 0.10 |
| 38 (Inv.) | 160 | 160 | 0.08 | 0.11 |
| 39 (Inv.) | 130 | 135 | 0.08 | 0.12 |
| 40 (Inv.) | 130 | 125 | 0.08 | 0.12 |
| 41 (Inv.) | 135 | 130 | 0.08 | 0.12 |
| 42 (Comp.) | 100 | 70 | 0.07 | 0.17 |
| 43 (Comp.) | 90 | 65 | 0.08 | 0.16 |
| 44 (Inv.) | 150 | 155 | 0.08 | 0.11 |
| 45 (Inv.) | 130 | 130 | 0.08 | 0.11 |
| 46 (Inv.) | 130 | 125 | 0.08 | 0.11 |
| 47 (Comp.) | 120 | 150 | 0.08 | 0.15 |
| 48 (Comp.) | 120 | 150 | 0.08 | 0.16 |
| 49 (Inv.) | 155 | 155 | 0.08 | 0.13 |
| 50 (Inv.) | 160 | 155 | 0.08 | 0.12 |
| 51 (Inv.) | 125 | 115 | 0.08 | 0.14 |

*1: after 5-day storage
*2: after 1-year storage at 30° C. and 60% RH

As apparent from the results shown in Table 8, the light-sensitive materials of the present invention have an excellent storability.

EXAMPLE 4

The coated samples were prepared in the same manner as Examples 1 and 2, provided that Samples 1 to 29 prepared in Examples 1 and 2 were processed in the following processing methods (I) and (II).

The development was carried out with FPM 9000 manufactured by Fuji Photo Film Co., Ltd. after a processing time was settled and the processing solutions were changed.

| | Processing (I) | Processing (II) |
|---|---|---|
| Development | Developing solution (I)<br>35° C., 25 sec. | Developing solution (II)<br>35° C., 12.5 sec. |
| Fixation | Fixing solution (I)<br>30° C., 20 sec. | Fixing solution (II)<br>30° C., 10 sec. |
| Water-wash | 15° C., 15 sec. | 15° C., 7.5 sec. |
| Drying | 40° C. | 50° C. |
| Dry to Dry Processing time. | 90 sec. | 48 sec. |

Developing solution (I)
1-Phenyl-3-pyrazolidne 1.5g
Hydroquinone 30 g
5-Nitroidazole 0.25 g
Potassium bromide 3.0 g
Sodium sulfite anhydrous 50 g
Potassium hydroxide 30 g
Boric acid 10g
Glutaric aldehyde 5 g
Water added to make 1 liter (pH adjusted to 10.20)
Fixing solution (I)
Ammonium thiosulfate (70 wt %/vol %) 200 ml
Disodium ethylenediaminetetracetate dihydrate 0.02 g
Sodium sulfite 15 g
Boric acid 10 g
Sodium hydroxide 6.7 g
Glacial acetic acid 15 g
Aluminium sulfate 10 g
Sulfuric acid (36N) 3.9 g
Water added to make 1 liter (pH adjusted to 4.25)
Developing solution (II)
Potassium hydroxide 29 g
Sodium sulfite 44.2 g
Sodium bicarbonate 7.5 g
Boric acid 1.0 g
Diethylene glycol 12 g
Ethylenediamineteracetic acid 1.7g
5-Methylbenzotriazole 0.06 g
Hydroquinone 30 g
Glacial acetic acid 18 g
Triethylene glycol 12 g
5-Nitroindazole 0.25 g
1-Phenyl-3-pyrazolidone 2.8 g
Glutaric aldyehyde (50 wt %/wt %) 9.86 g
Sodium metabisulfite 12.6 g
Potassium bromide 3.7g
Water added to make 1.0 liter The photographic property and the stress blackening property of the samples were measured, and it was found that the light-sensitive materials of the present invention had a small stress blackening and a high sensitivity similar to the results of Examples 1 and 2.

EXAMPLE 5

The coated samples were prepared in the same manner as Samples 30 to 51 of Example 3 and were subjected to the measurement of property change after aging as compared to the property of the fresh samples, wherein they were processed in the same processing methods (I) and (II) as in Example 4. The results were almost the same as those in Example 3, and it was confirmed that the light-sensitive materials of the present invention showed excellent performance in either of immediately after coating and after aging and had a small property changes in aging.

EXAMPLE 6

To 1 liter of water containing 20 g of gelatin, 5 g of potassium bromide and 3 ml of a 5% aqueous solution of thioether $HO(CH_2)_2S(CH_2)_2S(CH_2)_2OH$, were added a solution containing 8.35 g of silver nitrate and a solution containing 3 g of potassium bromide and 0.4 g of potassium iodide by the double jet method for 45 seconds while stirring at 75° C., followed by adding 2 g of potassium bromide and then a solution containing 5 g of silver nitrate over a period of 10 minutes. Subsequently, an aqueous solution containing 135 g of silver nitrate and an aqueous solution of potassium bromide were added by the controlled double jet method over a period of 25 minutes while maintaining the pAg at 8.1, wherein a flowing amount was accelerated so that the flowing amount at completion of the addition became 10 times as much as that at the initiation thereof. After completion of the addition, 15 ml of a 2N solution of potassium thiocyanate were added. Then, the temperature of the solution was lowered to 35° C. and the water soluble salts were removed by a settling method. Thereafter, the solution was heated to 40° C., and 35 g of gelatin, 2.5 g of phenoxyethanol and a thickener were added, followed by adjusting the pH and the pAg to 6.1 and 8.3, respectively, with caustic soda, potassium bromide and silver nitrate. After raising the temperature to 56° C., 735 mg of the sensitizing dye 7 were added. Further, 10 minutes later, the compound shown in Table 9, 110 mg of potassium thiocyanate and 2.6 mg of chlorauric acid were added to effect a ripening for 60 minutes, followed by rapidly cooling for solidification.

The emulsion thus obtained comprised the grains having an aspect ratio of 3 or more, accounting for 93% of the total projected area of the whole grains in the emusion, and the grains having the aspect ratio of 3 or more had an average projected area-corresponding circle diameter of 1.4 μm, a standard deviation of 20%, an average thickness of 0.2 μm and an average aspect ratio of 7. Thus, Emulsions A1 to E1 were prepared.

TABLE 9

| Emulsion | Sulfur sensitizer | Selenium senitizer |
|---|---|---|
| A1 | (a-l) $1.6 \times 10^{-5}$ mol/mol Ag | |
| B1 | (a-l) $0.96 \times 10^{-5}$ mol/mol Ag | b-1 $0.64 \times 10^{-5}$ mol/mol Ag |
| C1 | (a-l) $0.64 \times 10^{-5}$ mol/mol Ag | b-1 $0.96 \times 10^{-5}$ mol/mol Ag |
| D1 | (a-l) $0.64 \times 10^{-5}$ mol/mol Ag | b-2 $0.96 \times 10^{-5}$ mol/mol Ag |
| E1 | (a-l) $0.3 \times 10^{-5}$ mol/mol Ag | b-2 $1.3 \times 10^{-5}$ mol/mol Ag |

Sensitizer a-1: Sodium thiosulfate b-1:

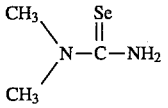

b-2:

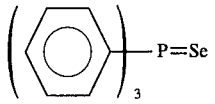

Emulsions F1 to J1 were prepared in the same manner as in the preparation of Emulsions A1 to El, except that 2.0 mg of thiourea dioxide as a reducing agent was added when 60% of the grain formation was completed.

Further, Emulsions K1 to O1 were prepared in the same manner as in the preparation of Emulsions A1 to E1, except that 0.05 mg of thiourea dioxide was added before adding the sensitizing dye in The chemical sensitization to provide a reduction sensitization. These emulsions are shown in Table 10.

TABLE 10

| Emulsion | Sulfur/Se sensitization | | Reduction sensitization |
|---|---|---|---|
| A1 | a-1 | 100% | None |
| B1 | a-1/b-1 = | 60/40 | None |

TABLE 10-continued

| Emulsion | Sulfur/Se sensitization | | Reduction sensitization |
|---|---|---|---|
| C1 | a-1/b-1 = | 40/60 | None |
| D1 | a-1/b-2 = | 40/60 | None |
| E1 | a-1/b-2 = | 20/80 | None |
| F1 | a-1 | 100% | Inside of grains |
| G1 | a-1/b-1 = | 60/40 | Inside of grains |
| H1 | a-1/b-1 = | 40/60 | Inside of grains |
| I1 | a-1/b-2 = | 40/60 | Inside of grains |
| J1 | a-1/b-2 = | 20/80 | Inside of grains |
| K1 | a-1 | 100% | Surface of grains |
| L1 | a-1/b-1 = | 60/40 | Surface of grains |
| M1 | a-1/b-1 = | 40/60 | Surface of grains |
| N1 | a-1/b-2 = | 40/60 | Surface of grains |
| O1 | a-1/b-2 = | 20/80 | Surface of grains |

The following compounds were added to the emulsions thus prepared to make the coating solutions.

4-Hydroxy-6-methyl-1,3,3*a*,7-tetrazaindene 1.94 g 2,6-bis(hydroxyamino)-4-diethylamino-1,3,5-tiazine 80 mg Poly-sodium acrylate (average molecular weight: 41,000) 4.0 g Separately, a surface protective layer coating solution was prepared by dispesing in water dextrane having an average molecular weight of 40,000, polymethyl methacrylate fine grains (an average grain size: 3.0 μm), polyethylene oxide, and poly-sodium acrylate (an average molecular weight:41,000) as well as gelatin.

The emulsion coating solutions and surface protective layer coating solutions were applied on one side of a polyethylene terephthalate support by a simultaneous extrusion method, followed by drying, whereby light-sensitive materials (Sample A and Samples 52 to 61 were prepared. The amounts of coated silver, and the amounts of gelatin and dextrane contained in the surface protective layer were set at 3.3 g/m$^2$, 0.8 g/m$^2$ and 0 8 g/m$^2$, respectively. In coating, 1,2-bis(sulfonylacetamide)ethane was added as a hardener to the emulsion layer in a proportion of 8 millimole/100 g-gelatin.

Samples 52 to 61 were exposed to a green light for 1/20 second and then were subjected to a development with a developing solution (III) at 35° C. for 8 or 24 seconds, followed by fixing, rinsing and drying.

Developing solution (III)

1-phenyl-3-pyrazolidone 1.5 g

Hydroquinone 30 g

5-Nitroindazole 0.25 g

Potassium bromide 3.0 g

Potassium bromide 3.0 g

Sodium sulfite anhydrous 50 g

Potassium hydroxide 30 g

Boric acid 5 g

Glutaric aldehyde 10 g

Water added to make 1 liter (pH adjusted to 10.20)

Sensitivity of the samples measured is a relative value of a reciprocal necessary to give a density of fog +1, taking that of Sample A subjected to development for 24 seconds as being 100. The results are shown in Table 11.

TABLE 11

| Sample No. | Emulsion | 8" S* | Fog | 24" S* | Fog |
|---|---|---|---|---|---|
| A (Comp.) | A1 | 50 | 0.02 | 100 | 0.03 |
| 52 (Comp.) | F1 | 62 | 0.03 | 125 | 0.04 |
| 53 (Inv.) | G1 | 110 | 0.04 | 140 | 0.05 |
| 54 (Inv.) | H1 | 118 | 0.05 | 146 | 0.05 |
| 55 (Inv.) | I1 | 120 | 0.04 | 150 | 0.05 |
| 56 (Inv.) | J1 | 123 | 0.05 | 152 | 0.06 |
| 57 (Comp.) | K1 | 65 | 0.05 | 120 | 0.05 |
| 58 (Inv.) | L1 | 105 | 0.04 | 138 | 0.05 |
| 59 (Inv.) | M1 | 110 | 0.05 | 143 | 0.06 |
| 60 (Inv.) | N1 | 116 | 0.04 | 152 | 0.05 |
| 61 (Inv.) | O1 | 120 | 0.05 | 150 | 0.06 |

*Sensitivity

As apparent from the results shown in Table 11, it is seen that the application of a reduction sensitization provides a high sensitivity and accelerates a development especially in applying the combination of the Se sensitization plus gold sensitization with a sulfur sensitization.

EXAMPLE 7

Various emulsions F2–F4, H2–H4, J2–J4, M2–M4 and O2–O4 were prepared as shown in Table 12 in the same manner as in Example 6, except that $1\times10^{-4}$ mole/mole-Ag of thiosulfonic acids shown below were added to Emulsions F1, H1 and J1 (with providing the reduction sensitization to the inside of the grains), and Emulsions M1 and O1 (with providing the reduction sensitization to the surface of the grains) at the time when 90% of the grain formation was completed.

Thiosulfonic acid compounds:

C-1

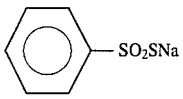

C-2

$C_2H_5SO_2SNa$

C-3

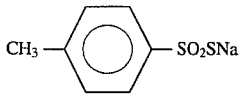

TABLE 12

| Emulsion | Base emulsion | Thiosulfonic acid |
|---|---|---|
| F2 | F1 | C-1 |
| F3 | F1 | C-2 |
| F4 | F1 | C-3 |
| H2 | H1 | C-1 |
| H3 | H1 | C-2 |
| H4 | H1 | C-3 |
| J2 | J1 | C-1 |
| J3 | J1 | C-2 |
| J4 | J1 | C-3 |
| M2 | M1 | C-1 |
| M3 | M1 | C-2 |
| M4 | M1 | C-3 |
| O2 | O1 | C-1 |
| O3 | O1 | C-2 |
| O4 | O1 | C-3 |

Emulsion coating solutions were prepared in the same manner as in Example 6 using these emulsions and applied together with the same surface protective layer coating solution as that in Example 6, whereby light-sensitive materials (Sample 62 to 76) were prepared.

These coated samples and the light-sensitive material Samples 52, 54, 56, 59 and 61 each prepared in Example 6 were subjected to light-exposure and development in the same manners as in Example 6 to obtain the results shown in Table 13.

TABLE 13

| Sample No. | Emulsion | 8" S* | Fog | 24" S* | Fog |
|---|---|---|---|---|---|
| 52 (Comp.) | F1 | 62 | 0.03 | 125 | 0.04 |
| 62 (Comp.) | F2 | 60 | 0.03 | 121 | 0.04 |
| 63 (Comp.) | F3 | 62 | 0.03 | 138 | 0.03 |
| 64 (Comp.) | F4 | 62 | 0.03 | 128 | 0.04 |
| 54 (Inv.) | H1 | 118 | 0.05 | 146 | 0.05 |
| 65 (Inv.) | H2 | 130 | 0.03 | 150 | 0.04 |
| 66 (Inv.) | H3 | 138 | 0.03 | 158 | 0.03 |
| 67 (Inv.) | H4 | 130 | 0.03 | 148 | 0.03 |
| 56 (Inv.) | J1 | 123 | 0.05 | 152 | 0.06 |
| 68 (Inv.) | J2 | 128 | 0.03 | 168 | 0.04 |
| 69 (Inv.) | J3 | 139 | 0.02 | 175 | 0.03 |
| 70 (Inv.) | J4 | 133 | 0.03 | 160 | 0.04 |
| 59 (Inv.) | M1 | 110 | 0.05 | 143 | 0.06 |
| 71 (Inv.) | M2 | 118 | 0.03 | 150 | 0.04 |
| 72 (Inv.) | M3 | 128 | 0.03 | 161 | 0.03 |
| 73 (Inv.) | M4 | 115 | 0.03 | 160 | 0.03 |
| 61 (Inv.) | O1 | 120 | 0.05 | 150 | 0.06 |
| 74 (Inv.) | O2 | 130 | 0.03 | 160 | 0.04 |
| 75 (Inv.) | O3 | 141 | 0.02 | 170 | 0.03 |
| 76 (Inv.) | O4 | 133 | 0.03 | 163 | 0.04 |

*Sensitivity

As apparent from the results shown in Table 13, it is seen that the combined use of thiosulfonic acid markedly lowers fog of the emulsions which were subjected to the reduction sensitization in combination of the Se sensitization while increasing a sensitivity.

It was confirmed that the same effect could be obtained by adding the thiosulfonic acid either before (e.g., at an initial stage of the grain formation) or after adding the reduction sensitizers in the chemical sensitization while the added amount of the thiosulfonic acid may necessarily be adjusted.

EXAMPLE 8

The light-sensitive material, Samples 77 to 97, were prepared in the same manner as Example 6 using Emulsions B1, G1, N1, J2, and M3 each prepared in Examples 6 and 7 and Emulsion E3, except that the water soluble mercapto compounds shown below were added as shown in Table 14, whereby the light-sensitive material, Samples 77 to 97, were prepared in the same manners as Example 6. Emulsion E3 used above was prepared in the same manner as in the preparation of Emulsion J3 except for using Emulsion E1 in place of Emulsion J1.

Mercapto compounds:

(d-1)

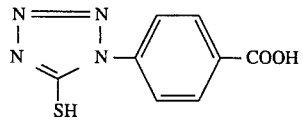

(d-2)

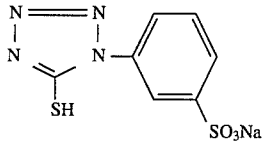

-continued

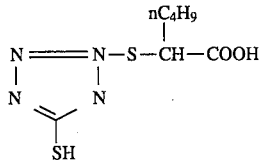

(d-3)

These light-sensitive material samples were evaluated in the same manner as in Example 6 to obtain the results as shown in Table 14.

TABLE 14

| Sample No. | Emulsion | Mercapto compound | 8 seconds S* | 8 seconds Fog | 24 seconds S* | 24 seconds Fog |
|---|---|---|---|---|---|---|
| 77 ** | B1 | — | 58 | 0.02 | 105 | 0.03 |
| 78 ** | B1 | d-1 | 60 | 0.02 | 115 | 0.03 |
| 79 ** | B1 | d-2 | 65 | 0.02 | 110 | 0.03 |
| 80 ** | B1 | d-3 | 60 | 0.02 | 115 | 0.03 |
| 53 (Inv.) | G1 | — | 120 | 0.04 | 140 | 0.05 |
| 81 (Inv.) | G1 | d-1 | 110 | 0.03 | 148 | 0.03 |
| 82 (Inv.) | G1 | d-2 | 122 | 0.03 | 150 | 0.03 |
| 83 (Inv.) | G1 | d-3 | 125 | 0.02 | 145 | 0.03 |
| 60 (Inv.) | N1 | — | 116 | 0.04 | 152 | 0.05 |
| 84 (Inv.) | N1 | d-1 | 120 | 0.02 | 151 | 0.03 |
| 85 (Inv.) | N1 | d-2 | 133 | 0.02 | 161 | 0.03 |
| 86 (Inv.) | N1 | d-3 | 122 | 0.02 | 160 | 0.03 |
| 68 (Inv.) | J2 | — | 128 | 0.03 | 168 | 0.03 |
| 87 (Inv.) | J2 | d-1 | 135 | 0.02 | 170 | 0.03 |
| 88 (Inv.) | J2 | d-2 | 140 | 0.02 | 175 | 0.03 |
| 89 (Inv.) | J2 | d-3 | 138 | 0.03 | 169 | 0.03 |
| 90 (Inv.) | M3 | — | 128 | 0.03 | 161 | 0.03 |
| 91 (Inv.) | M3 | d-1 | 141 | 0.02 | 182 | 0.03 |
| 92 (Inv.) | M3 | d-2 | 146 | 0.02 | 191 | 0.03 |
| 93 (Inv.) | M3 | d-3 | 138 | 0.02 | 188 | 0.03 |
| 94 ** | E3 | — | 65 | 0.03 | 110 | 0.04 |
| 95 ** | E3 | d-1 | 60 | 0.03 | 121 | 0.04 |
| 96 ** | E3 | d-2 | 70 | 0.03 | 120 | 0.03 |
| 97 ** | E3 | d-3 | 63 | 0.03 | 105 | 0.04 |

*Sensitivity
*Reference samples

Thus, it is apparent that an inhibited fog and a high sensitivity can be obtained with the emulsions which were subjected to the Se sensitization as well as the reduction sensitization.

EXAMPLE 9

The following coated samples were prepared in the same manner as in Example 1 using the emulsions described in Examples 6 to 8. These samples are summarized in Table 15.

TABLE 15

| Sample No. | Emulsion | Mercaptocompound |
|---|---|---|
| 98 (Comp.) | A1 | — |
| 99* | E1 | — |
| 100 (Comp.) | K1 | — |
| 101 (Inv.) | I1 | — |
| 102 (Inv.) | O1 | — |
| 103 (Inv.) | M1 | d-1 |
| 104 (Inv.) | N3 | d-3 |

*Reference sample

Preparation of coating solution

The following compounds per mole of silver halide were added to prepare the coating solutions.

2,6-bis(hydroxyamino)-4-diethylamino-1,3,5-triazine 72 mg

Trimethylol propane 9 g

Dextrane ( average molecular weight: 39,000) 18.5 g

Poly-sodium styrenesulfonate 1.8 g (average molecular weight: 600,000)

Hardener (1,2-bis(vinylsulfonylacetamide)ethane (an addition amount was adjusted so that a swelling ratio became 230%)

Preparation of light-sensitive material

Using the above-obtained coating solutions, light-sensitive materias were prepared and processed in the same manner as in Example 1, and the photographic properties thereof were measuered. The results are shown in Table 16.

TABLE 16

| Sample No. | Sensitivity | Dmin (Fog) |
|---|---|---|
| 98 (Comp.) | 100 | 0.12 |
| 99* (Comp.) | 115 | 0.15 |
| 100 (Comp.) | 112 | 0.15 |
| 101 (Inv.) | 151 | 0.16 |
| 102 (Inv.) | 171 | 0.14 |
| 103 (Inv.) | 175 | 0.14 |
| 104 (Inv.) | 190 | 0.13 |

*Reference sample

As shown by the results summarized in Table 16, the emulsion of the present invention showed the photographic performances of a high sensitivity and a low fog. Further, it was found that the coated samples in which the emulsions of the present invention were used showed the good results in the properties such as a roller mark property in drying and a scratching property.

EXAMPLE 10

The emulsions were prepared in the same manner as Examples 6 to 8, except that potassium iodide corresponding 2 millimole/mole of Ag was added before adding a potassium thiocyanate after completion of the grain formation. The emulsions thus prepared were evaluated in the same manner as in Example 6 to confirm that the emulsions of the present invention could provide a further high sensitivity and an excellent developability.

While the invention has been described in detail and with reference to specific embodiments thereof, it will be apparent to one skilled in the art the various changes and modifications can be made therein without departing from the spirit and scope thereof.

What is claimed is:

1. A silver halide photographic material comprising:

a support having provided thereon at least one light-sensitive silver halide emulsion layer containing a silver halide emulsion, wherein the silver halide emulsion has been subjected to a chemical sensitization with a selenium compound, and wherein (1) the silver halide emulsion layer provided on said support contains a compound represented by formula (III), which compound has been added to said silver halide emulsion layer after said chemical sensitization, or (2) another layer provided on said support contains a compound represented by formula (III):

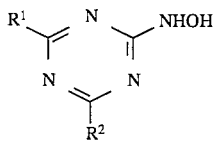

(III)

wherein $R^1$ and $R^2$ may be the same or different and each represents a hydroxy group, an amino group, an alkoxy group, a phenoxy group, an alkyl group, an aryl group, an alkylthio group, or a phenylthio group.

2. The photographic material as in claim 1, wherein said silver halide emulsion contains tabular grains having an aspect ratio of 3 or more which account for 70 % or more of the sum of the projected areas of all the silver halide grains in the emulsion.

3. The photographic material as in claim 1 wherein a compound represented by formula (I) or formula (II) is contained in said silver halide emulsion layer or said another layer:

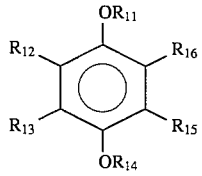

(I)

wherein $R_{12}$, $R_{13}$, $R_{15}$ and $R_{16}$ may be the same or different and each represents a hydrogen atom, an alkenyl, alkynyl, aralkyl, aryl, alkoxy, aryloxy, alkylthio, arylthio, carbonamide, sulfonamide, ureido, alkoxycarbonylamino, aryloxycarbonylamino, acyloxy, sulfamoylamino, sulfonyloxy, sulfamoyl, acyl, sulfonyl, alkoxycarbonyl, or aryloxycarbonyl group having up to 30 carbon atoms, a halogen atom, a hydroxy group, a sulfo group, a carboxyl group, a cyano group, or a 3- to 12-membered heterocyclic group containing at least one oxygen, nitrogen, sulfur, phosphorus, selenium, or tellurium atom; $R_{11}$ and $R_{14}$ each represents a hydrogen atom or a protective group capable of being released in an alkaline condition; provided that any two of $R_{11}$ to $R_{16}$ may be combined with each other to form a ring;

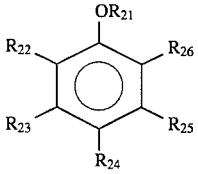

(II)

wherein $R_{22}$ to $R_{26}$ may be the same or different and each represent a hydrogen atom, an alkyl, alkenyl, alkynyl, aralkyl, aryl, aryloxy, alkylthio, arylthio, carbonamide, sulfonamide, ureido, alkoxycarbonylamino, aryloxycarbonylamino, acyloxy, sulfamoylamino, sulfonyloxy, carbamoyl, sulfamoyl, acyl, sulfonyl, alkoxycarbonyl, or aryloxycarbonyl group having up to 30 carbon atoms, a halogen atom, a sulfo group, a carboxyl group, a cyano group, or a 3- to 12-membered heterocyclic group containing at least one oxygen, nitrogen, sulfur, phosphorus, selenium or tellurium atom; $R_{21}$ represents a hydrogen atom or a protective group capable of being released in an alkaline condition; provided that any two of $R_{21}$ to $R_{26}$ may be combined with each other to form a ring and that at least one of $R_{22}$ to $R_{26}$ is substituted with a group having a silver halide-adsorption accelerating group or a group having 6 or more carbon atoms and at least one of $R_{22}$ to $R_{26}$ is substituted with a group capable of being released in an alkaline condition.

4. The photographic material as in claim 3, wherein $R_{11}$ represents a protective group capable of being released in an alkaline condition, and $R_{14}$ represents a hydrogen atom or a protective group capable of being released in an alkaline condition.

5. The photographic material as in claim 3, wherein the compound of formula (I) or (II) is contained in an amount of $1\times10^{-4}$ to 1 mole per mole of silver halide.

6. The photographic material as in claim 4, wherein the compound of formula (I) or (II) is contained in an amount of $1\times10^{-4}$ to 1 mole per mole of silver halide.

7. The photographic material as in claim 1, wherein the compound of formula (III) is contained in an amount of 0.01 to 10 g per mole of silver.

8. The photographic material as in claim 1, wherein said selenium compound is represented by formula (IV) or (V):

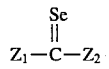

(IV)

wherein $Z_1$ and $Z_2$ may be the same or different and each represents an alkyl group, an alkenyl group, an aryl group, a heterocyclic group, $—NR_1(R_2)$, $—OR_3$ or $—SR_4$; and $R_1$, $R_2$, $R_3$ and $R_4$ may be the same or different and each represents an alkyl group, an aryl group, a heterocyclic group, a halogen atom or an acyl group;

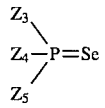

(V)

wherein $Z_3$, $Z_4$ and $Z_5$ may be the same or different and each represents an aliphatic group, an aromatic group, a heterocyclic group, $—OR_7$, $—NR_8(R_9)$, $—SR_{10}$, $—SeR_{11}$, a halogen atom or a hydrogen atom; $R_7$, $R_{10}$ and $R_{11}$ each represents an aliphatic group, an aromatic group, a heterocyclic group, a hydrogen atom or a cation; and $R_8$ and $R_9$ each represents an aliphatic group, an aromatic group, a heterocyclic group, or a hydrogen atom.

9. The photographic material as in claim 1, wherein said selenium compound is added in an amount of $1\times10^{-8}$ mole or more per mole of silver halide.

* * * * *